US007467793B2

(12) United States Patent
Tanabe

(10) Patent No.: US 7,467,793 B2
(45) Date of Patent: Dec. 23, 2008

(54) CONVEYER AND IMAGE RECORDING APPARATUS

(75) Inventor: Tsuyoshi Tanabe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 610 days.

(21) Appl. No.: 11/075,890

(22) Filed: Mar. 10, 2005

(65) Prior Publication Data

US 2005/0206072 A1 Sep. 22, 2005

(30) Foreign Application Priority Data

Mar. 22, 2004 (JP) ..... 2004-083378

(51) Int. Cl.
*B65H 9/04* (2006.01)

(52) U.S. Cl. ..... 271/245; 271/246; 271/227

(58) Field of Classification Search ..... 271/242, 271/227–228, 245–247, 111, 226, 229, 243, 271/244, 261, 265.03, 10.02, 10.12; 399/395; 355/407, 408, 27, 28, 29
See application file for complete search history.

(56) References Cited

U.S. PATENT DOCUMENTS 5,918,876 A * 7/1999 Maruyama et al. ..... 271/228
5,967,506 A * 10/1999 Miki et al. ..... 271/10.13
6,356,735 B1 * 3/2002 Hozumi ..... 399/395
6,409,400 B1 * 6/2002 Arai ..... 396/612
2003/0179351 A1 * 9/2003 Morita ..... 355/40

FOREIGN PATENT DOCUMENTS

JP 2001-174927 A 6/2001

* cited by examiner

*Primary Examiner*—Patrick H Mackey
*Assistant Examiner*—Jeremy Severson
(74) *Attorney, Agent, or Firm*—Sughrue Mion, PLLC

(57) ABSTRACT

On a paper path in a photo printer, a skew corrector is provided to correct skew of recording sheets simultaneously in two lines. The skew corrector consists of a first conveyer roller pair, a second conveyer roller pair and a strike guide. The recording sheets are conveyed by the first conveyer roller pair after their leading edges strike on the strike guide, to bend the recording sheets flexibly between the first conveyer roller pair and the strike guide, thereby to correct skew of each recording sheet. A necessary transport amount for correcting the skew of the recording sheet is calculated on each line based on detection signals from photo sensors, which are disposed between the first and second conveyer roller pairs, and a width of the recording sheet. The recording sheets of the respective lines are conveyed by the largest necessary transport amount among the calculated ones.

14 Claims, 14 Drawing Sheets

CONVEYER AND IMAGE RECORDING APPARATUS

FIELD OF THE INVENTION

The present invention relates to a conveyer that conveys sheets in parallel lines and to an image recording apparatus that records an image on a sheet of recording material conveyed by the conveyer.

BACKGROUND ART

For example, a photo printer records an image by so-called scanning exposure that scans recording light in a main scan direction perpendicular to a sub scan direction while nipping and conveying a cut-sheet of photosensitive material in the sub scan direction by plural pairs of conveyer rollers provided on a paper path.

In order to obtain a high-quality photo print, it is necessary that the photosensitive material is exposed in an appropriate position and direction. However the cut-sheet of photosensitive material often skews during being conveyed because of mounting tolerance of units in the photo printer and tolerance of parts of individual units. When the photosensitive material on the skew is exposed, the recorded image is also on the skew to the photosensitive material. Especially because the photo print is often output as a white-rimmed print where the recorded image is surrounded with a white rim of a given width, the image recorded on the skew extremely degrades the quality of the photo print.

The skew can be corrected by striking a leading edge of an individual sheet of photosensitive material on a conveyer roller pair in its stopping state and by squeezing the sheet in between the conveyer rollers of the pair till the whole leading edge is oriented parallel to an axial direction of the conveyer rollers, i.e. a main scan direction, while bending the photosensitive material flexibly and sufficiently enough to correct the skew.

As disclosed in Japanese Laid-open Patent Application No. 2001-174927, especially in pages 5 and 6, in order to improve a processing capacity of the photo printer (the number of processed sheets per unit time), it is preferable to record images simultaneously on plural sheets of photosensitive material which are apposed in the main scan direction and are conveyed in parallel to each other along the sub scan direction. In this case, the skew can also be corrected by striking the leading edges of the plural sheets on a conveyer roller pair in its stopping state and by flexibly bending the sheets of recording material. In addition to that, this method is useful for aligning the leading edges of the apposed sheets as well as for correcting the skew.

As the sheets of photosensitive material conveyed in plural lines are different in skew degree or in leading edge position between the lines, transport amounts or squeezing amounts necessary for correcting the skew of the respective sheets are different between the lines. In order to correct the skew of any sheet without fail, it is necessary to preset the transport amount so large that it takes more time to correct the skew. As a result, the processing capacity per unit time goes down.

SUMMARY OF THE INVENTION

In view of the foregoing problems, an object of the present invention is to provide a conveyer that can correct the skew of sheets conveyed in parallel lines in a short time and without fail.

Another object of the present invention is to provide an image recording apparatus provided with such a conveyer.

A conveyer of the present invention comprises:

a conveying device for conveying plural sheets in parallel lines along a transport path;

a strike member placed at a downstream position of the conveying device;

detectors for detecting a leading edge of each of the sheets on each line; and a control device that calculates, based on respective widths and skew degrees of the sheets, transport amounts necessary for letting the whole leading edges of the sheets of respective lines strike on the strike member, and drives the conveying device to convey the sheets by the largest one of the calculated transport amounts so that the sheets strike at their leading edges on the strike member and are bent flexibly, thereby to correct their skew.

The control device preferably calculates the transport amounts for the respective lines based on positions of the sheets on the respective lines at a time when one of the detectors detect a leading edge of the latest one of the sheets.

According to an embodiment, the strike member consists of a pair of conveyer rollers stopping at the downstream position of the conveying device, the conveyer roller pair being driven to convey the sheets in the parallel lines after the skew is corrected.

The conveying device may be switched over between a nip position to nip the sheets and a release position to release the sheets, and the control device drives the conveying device in the nip position to convey the sheets by the largest transport amounts and, thereafter, switches the conveying device to the release position and drives the conveyer roller pair to start conveying the sheets in the parallel lines.

According to another embodiment, the conveyer further comprises a conveyer roller pair placed between the conveying device and the strike member, the conveyer roller pair being able to switch over between a nip position to nip the sheets and a release position to release the sheet, the conveyer roller pair being kept in the release position while the leading edges of the sheets as conveyed by the conveying device are passing through the conveyer roller pair.

The conveying device is able to switch over between the nip position and the release position, and the strike member is movable between a protruded position to protrude into the transport path and a retreat position to retreat from the transport path, and wherein the control device drives the conveying device in the nip position to convey the sheets by the largest transport amount to let the whole leading edges of the sheets strike on the strike member in the protruded position, and thereafter switches the conveyer roller pairs to the nip position, the conveying device to the release position, and the strike member to the retreat position, and thereafter drives the conveyer roller pair to start conveying the sheets in parallel lines.

According to another embodiment, the conveying device comprises a number of apposed conveyer roller pairs, the number being equal to the number of the parallel lines of the sheets, wherein the control device controls transport speeds of the conveyer roller pairs individually for each line such that one sheet whose necessary transport amount is calculated to be the largest is conveyed at the highest transport speed among other lines.

According to the present invention an image recording apparatus for recording images on recording materials comprises:

a conveying device for conveying plural sheets of the recording material in parallel lines along a transport path;

a strike member placed at a downstream position of the conveying device;

detectors for detecting a leading edge of each of the recording materials on each line; and a control device that calculates, based on respective widths and skew amounts of the recording materials, necessary transport amounts on respective lines, which are necessary for letting the whole leading edges of the recording materials strike on the strike member, and drives the conveying device to convey the sheets by the largest one of the calculated transport amounts so that the recording materials strike at their leading edges on the strike member and are bent flexibly, thereby to correct their skew comprising at least a magazine for supplying the recording materials to the transport path, and a memory storing identifying data of the magazine and characteristics of the recording materials supplied from the magazine in association with skew degree measurement data that is obtained previously by measuring skew degree of the recording materials, wherein the control device retrieves the skew degree measurement data from the memory on the basis of the identifying data of the magazine and the characteristics of the recording materials, to calculate the necessary transport amount.

The conveyer of the present invention and image recording apparatus using the inventive conveyer can correct the skew of the sheets conveyed in parallel lines in a short time and without fail.

BRIEF DESCRIPTION OF THE DRAWINGS

The above and other objects and advantages will be more apparent from the following detailed description of the preferred embodiments when read in connection with the accompanied drawings, wherein like reference numerals designate like or corresponding parts throughout the several views, and wherein.

DESCRIPTION OF THE PREFERRED EMBODIMENTS

Figure 1:
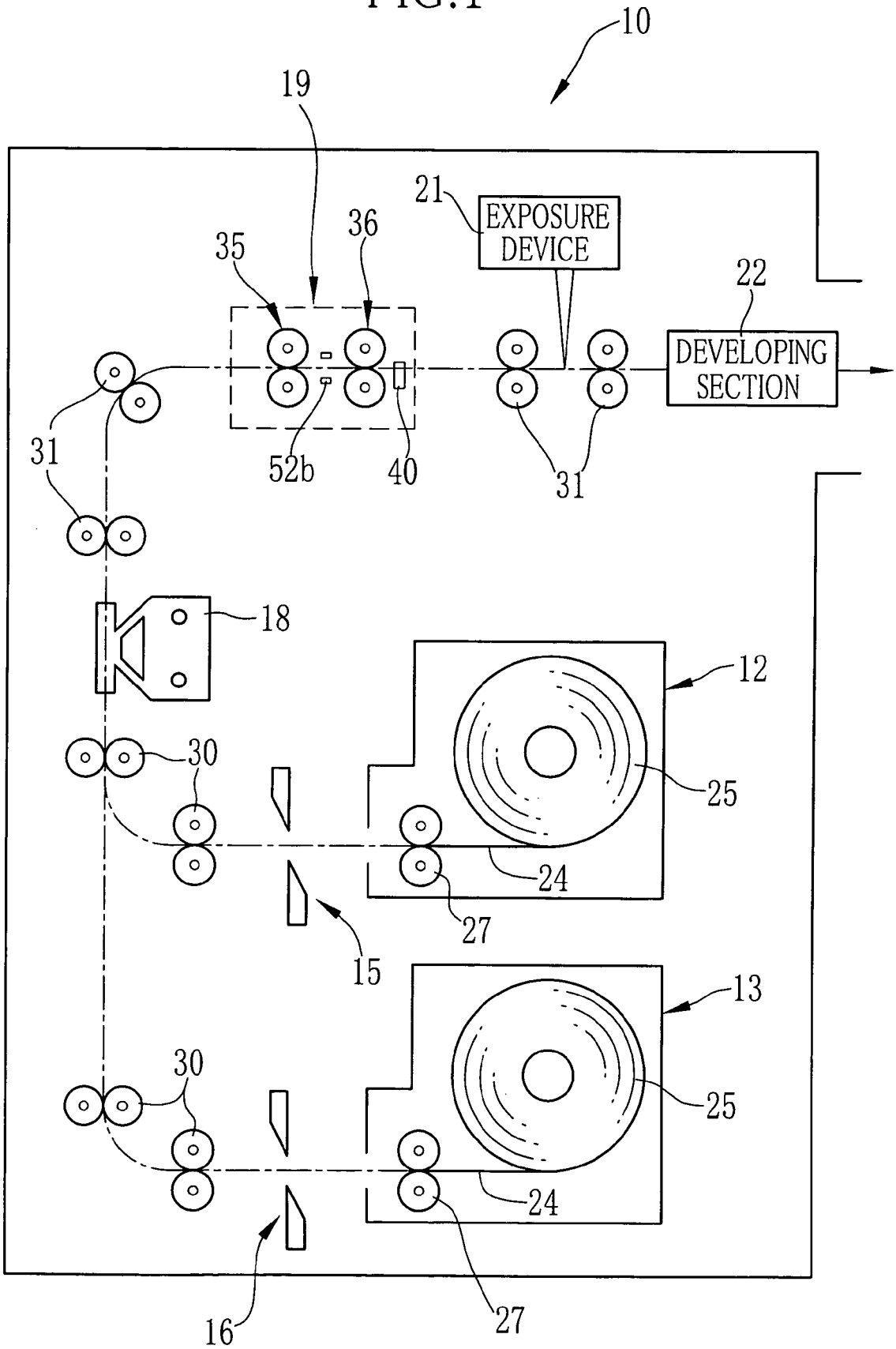
FIG. 1 is a schematic diagram illustrating the interior of an image recording apparatus using a conveyer of the present invention.

In FIG. 1, a photo printer 10 conveys cut-sheets of photosensitive material in two lines, exposes them simultaneously to make photo prints. As shown in FIG. 1, the photo printer 10 is provided with magazines 12 and 13, cutters 15 and 16, a back-printing device 18, a skew corrector 19, an exposure device 21 and a developing section 22.

Figure 2:
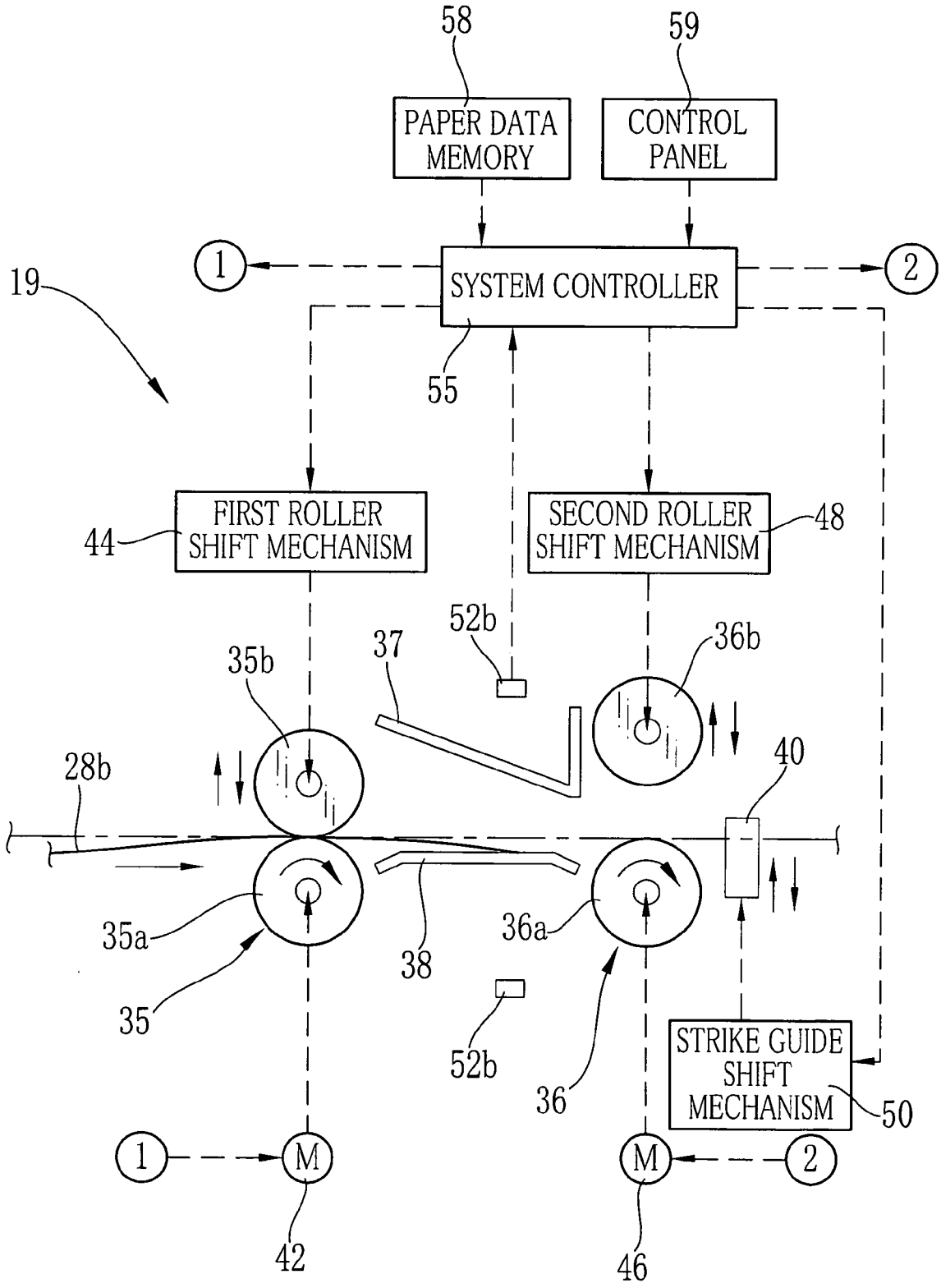
FIG. 2 is a side view illustrating the interior of a skew corrector in the image recording apparatus according to a first embodiment.
Figure 3:
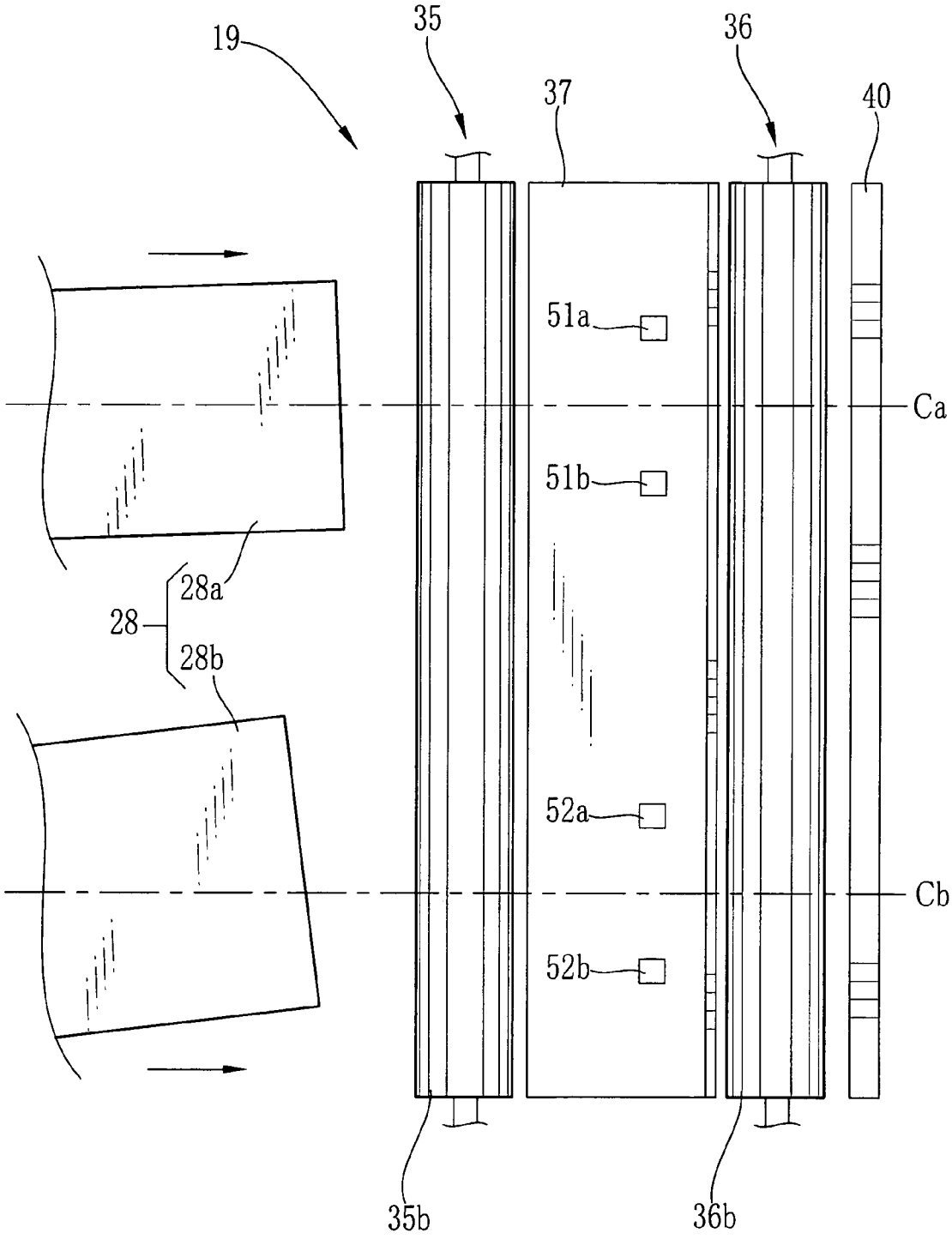
FIG. 3 is a schematic top plan view illustrating the interior of the skew corrector of FIG. 2.

The magazines 12 and 13 are loaded in given positions of the photo printer 10, containing a recording paper roll 25 each, that is a rolled long web of photosensitive recording paper 24. A paper feeding roller pair 27 is disposed near a paper outlet of each of the magazines 12 and 13. As the paper feeding roller pair 27 is rotated by a not-shown paper feeding motor, the photosensitive recording paper 24 is drawn from the recording paper roll 25 and fed toward the cutters 15 and 16. The cutters 15 and 16 are placed in face of the transport path of the photosensitive recording paper 24. When a leading end of the photosensitive recording paper 24 is fed out to a given length from the cutter 15 or 16, a not-shown cutter driving mechanism drives the cutter 15 or 16 to cut the photosensitive recording paper 24 into a recording sheet 28 (see FIGS. 2 and 3). The magazines 12 and 13 are movable along an axial direction of the paper rolls 25, and are able to feed out the recording sheets 28 in plural lines on a shared paper path, as shown in FIGS. 2 and 3. Instead of the two cutters 15 and 16, it is possible to dispose a single cutter near the back-printing device 18.

The recording sheets 28*a* and 28*b* respectively cut by the cutters 15 and 16 are conveyed by plural number of conveyer roller pairs 30 and 31 along the paper path shown in a chain-dotted line in FIG. 1, sequentially from the back-printing device 18 through the skew corrector 19 and the exposure device 21 to the developing section 22. The timing of sending the recording sheets 28*a* and 28*b* out from the respective magazines 12 and 13 is preset so that the recording sheets 28*a* and 28*b* are conveyed in plural apposed lines, e.g. in two parallel lines. At the back-printing device 18, necessary information including a film ID and a frame serial number is respectively printed on back sides of the recording sheets 28, i.e. on an opposite side to a photosensitive surface of each recording sheet 28.

The back-printed recording sheets 28*a* and 28*b* are conveyed in two lines to the skew corrector 19 by the conveyer roller pair 31. The skew corrector 19 represents the conveyer of the present invention. Though the detail will be described later, the skew corrector 19 corrects skew of the apposed recording sheets 28*a* and 28*b* at one time. After their skew is corrected, the recording sheets 28*a* and 28*b* are conveyed to the exposure device 21.

The exposure device 21 is provided with a known laser printer and a known image memory. The image memory stores image data that is read by a not-shown film scanner or is read from such a recording medium as a memory card though it is not shown in the drawings. The laser printer scans recording laser beams in a main scan direction that is in a direction perpendicular to a transport direction i.e. a sub scan direction. Intensities of the laser beams are modulated corresponding to images to record on the recording sheets 28*a* and 28*b*, so that the images are recorded simultaneously on the recording sheets 28*a* and 28*b* as they are conveyed in parallel in the transport direction. The exposed recording sheets 28*a* and 28*b* are sent to the developing section 22. After photographic processing for color development, fixing and washing at the developing section 22, the sheets are dried and then fed as photo prints out of the photo printer 10.

Next, the skew corrector 19 will be explained while using FIGS. 2 and 3.

FIG. 2 is a side view and FIG. 3 is a top plan view respectively illustrating the skew corrector 19. As shown in FIGS. 2 and 3, the skew corrector 19 consists of first and second conveyer roller pairs 35 and 36 to nip and convey the recording sheets 28*a* and 28*b* respectively, transport guides 37 and 38 to guide leading edges of the recording sheets 28*a* and 28*b* conveyed by the first conveyer roller pair 35 to the second conveyer roller pair 36, and a strike guide 40 which is placed behind the second conveyer roller pair 36 in the transport direction so that the leading edges of the recording sheets 28*a* and 28*b* strike thereon and that the recording sheets 28*a* and 28*b* flexibly bend as they are conveyed forth.

The first conveyer roller pair 35, as shown in FIG. 2, consists of a first capstan roller 35*a* rotated by a first feed motor 42 and a first nip roller 35*b* which is a driven roller. The rollers 35*a* and 35*b* are placed on either side of the paths of the recording sheets 28*a* and 28*b*. Connected to a first roller shift mechanism 44, the first nip roller 35*b* is movable between a nip position where the first nip roller 35*b* nips the recording sheets 28*a* and 28*b* and a release position retreated above the nip position in FIG. 2. As the first roller shift mechanism 44, it is possible to use an actuator using an air cylinder and a lead screw, a cam, a link member and the like.

The second conveyer roller pair 36 also has the same structure as the first conveyer roller pair 35, consisting of a second capstan roller 36*a* and a second nip roller 36*b*. The second capstan roller 36*a* is rotated by a second feed motor 46. The second nip roller 36*b* is also movable between the nip position and the release position by a second roller shift mechanism 48.

The transport guides 37 and 38 may be made from any material insofar as the material does not hurt recording sides of the recording sheets 28*a* and 28*b* or the recording sheets 28*a* and 28*b* do not stick to the transport guides 37 and 38 with static electricity while the recording sheets 28*a* and 28*b* are being guide to the second conveyer roller pair 36. Although the details will be explained later, while the skew is being corrected, recording sheets 28*a* and 28*b* flexibly bend with their recording sides convexly curved. Therefore the upper transport guide 37 in FIG. 2 leans back away from the paper path so as not to prevent the recording sheets 28*a* and 28*b* from bending.

The strike guide 40 has a base side perpendicular to the transport direction (the sub scan direction) of the recording sheets 28. In correcting the skew, the leading edges of the recording sheets 28*a* and 28*b* are struck on the base side of the strike guide 40, to bend the recording sheets 28*a* and 28*b* flexibly. Connected to a guide shift mechanism 50, the strike guide 40 is moved to a protruded position during the skew correction where it protrudes into the paper path, and to a retreat position after the skew correction where it retreats from the paper path. As the guide shift mechanism 50, an actuator using an air cylinder, a lead screw, a cam, a link member and the like is usable.

When correcting the skew, the second nip roller 36*b* is moved to the release position, and the strike guide 40 is moved to the protruded position. The recording sheet 28*a* or 28*b* is flexibly bent as the recording sheet 28*a* or 28*b* continue to be conveyed by the first conveyer roller pair 35 after one corner of the leading edge of the recording sheet 28*a* or 28*b* strikes on the strike guide 40. By use of a resilient force of the recording sheet 28*a* or 28*b* with which the sheet 28*a* or 28*b* is going to get back from the bent position to its normal position, the whole leading edge of the recording sheet 28*a* or 28*b* is brought into contact with the strike guide 40. As mentioned above, however, a necessary transport amount to let the whole leading edge strike on the strike guide 40 is different between the lines of the recording sheets 28, depending on skew degrees, positions of the leading edges and widths of the recording sheets 28*a* and 28*b*. For this reason, the transport amount for the skew correction has conventionally been set to a requisite maximum value, resulting in lowering the processing capacity. According to the present embodiment, on the contrary, the optimum transport amount is determined on each line depending upon the skew degree, the position of the leading edge and the width of the recording sheet, so as not to lower the processing capacity.

As a device for detecting the skew degrees and the positions of the leading edges of the recording sheets 28*a* and 28*b*, photo sensors 51*a*, 51*b*, 52*a* and 52*b* are installed between the first conveyer roller pair 35 and the second conveyer roller pair 36, to detect the passage of the recording sheet 28*a* or 28*b* on every line (see FIG. 3). Each of the photo sensors 51*a*, 51*b*, 52*a* and 52*b* consists of a light emitting element and a photoreceptive element arranged on either side of the path of the recording sheets 28*a* and 28*b*. The photo sensors 51*a* and 51*b* are placed symmetrically to a transport base center line Ca for the recording sheet 28*a* of one line, whereas the photo sensors 52*a* and 52*b* are placed symmetrically to a transport base center line Cb for the recording sheet 28*b* of the other line. Detection signals from the photo sensors 51*a*, 51*b*, 52*a* and 52*b* are sent to a system controller 55 in the photo printer 10. Though they are not shown in the drawings, apertures are formed through the transport guides 37 and 38 in corresponding positions to the photo sensors 51*a*, 51*b*, 52*a* and 52*b* so that their photoreceptive elements can detect light radiated from their light emitting elements respectively.

The system controller 55 controls operations of every part of the photo printer 10. The system controller 55 is connected to a paper data memory 58 and a control panel 59, as well as to the above-mentioned first feed motor 42, first roller shift mechanism 44, second motor 46, second roller shift mechanism 48, guide shift mechanism 50 and photo sensors 51*a*, 51*b*, 52*a* and 52*b*.

The paper data memory 58 stores a not-shown data table that corresponds to magazine identifying data on the magazines 12 and 13 available in the photo printer 10 and paper data including such characteristics of the recording paper as the thickness and width of the recording paper roll 25 housed in each of the magazines 12 and 13. Therefore, when the magazine identifying data on the magazines 12 and 13 is input or selected by a user via the control panel 59, the system controller 55 looks the data table in the paper data memory 58 to retrieve data on the width of the recording sheets 28*a* and 28*b* from the paper data which is associated with the magazine identifying data. The method of detecting the widths of the recording sheets 28*a* and 28*b* is not limited to the above one, but it is possible to use any other methods. For example, the user may input the widths directly through the control panel 59, or the recording paper roll 25 or the magazine 12 or 13 may be provided with a bar code or an IC chip containing the width data of the sheet, or it is possible to measure the width of the recording paper 24 as it is drawn from the recording paper roll 25.

Figure 4:
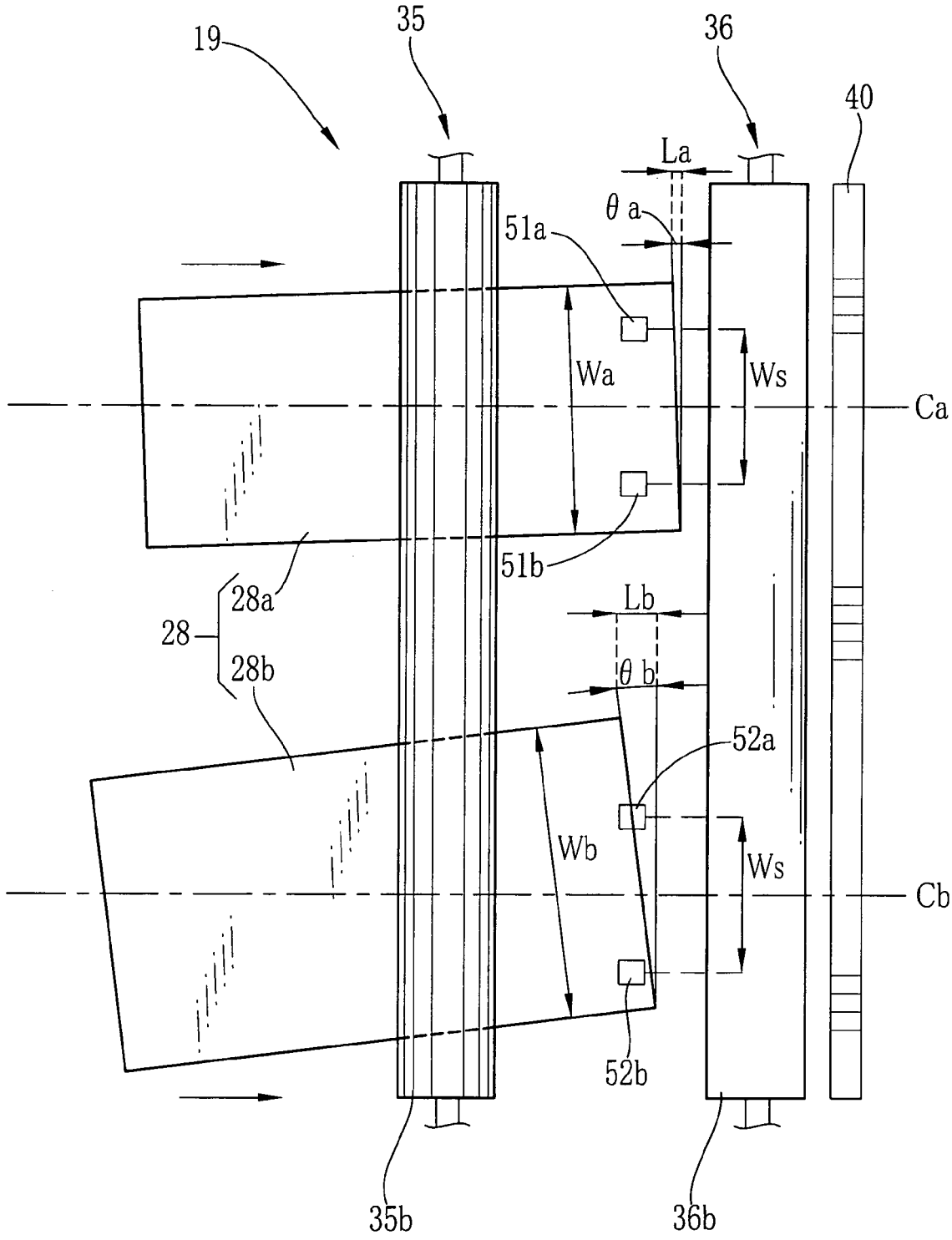
FIG. 4 is a schematic top plan view illustrating the skew corrector of FIG. 2 in a state where photo sensors calculate skew degree and necessary transport amount of recording sheets on each individual line.

As shown in FIG. 4, the skew degree of the recording sheet 28*a* can be easily determined from information on a difference in passage time when the leading edge of the recording sheet 28*a* passes the photo sensors 51*a* and 51*b*, a distance between the photo sensors 51*a* and 51*b* and information on transport speed of the recording sheet 28*a*, i.e. the number of drive pulses to the first feed motor 42. In the same way, the skew degree of the recording sheet 28*b* can be determined from information on a difference in passage time when its leading edge passes the respective photo sensors 52*a* and 52*b*, and a distance between the photo sensors 52*a* and 52*b* and information on transport speed of the recording sheet 28*b*, i.e. the number of drive pulses to the second feed motor 46.

More specifically, where Ta or Tb represents the difference in passage time of leading edge of the recording sheet 28*a* or 28*b* respectively, Ws represents the distance between the photo sensors 51*a* and 51*b* or 52*a* and 52*b*, and V represents the transport speed of the recording sheet 28, the system controller 55 calculates the skew degrees θa and θb of the recording sheets 28*a* and 28*b* respective from the following equations.

$$\theta a = \tan^{-1}[(V \cdot Ta)/Ws]$$

$$\theta b = \tan^{-1}[(V \cdot Tb)/Ws]$$

The system controller 55 also calculates a transport amount that is necessary to correct the skew of the leading edge of the recording sheet 28*a* or 28*b* after the photo sensor 51*a*, 51*b*, 52*a* or 52*b* detects the passage of the respective leading edges, hereinafter referred to as the necessary transport amount, on each line based on the width and skew degree θa or θb of the recording sheet 28*a* or 28*b*. The necessary transport amount is the sum of a first transport amount for bringing one corner of the leading edge into contact with the strike guide 40 and a second transport amount for bringing the whole leading edge into contact with the strike guide 40 after the one corner strikes on the strike guide 40.

When the recording sheets 28*a* and 28*b* are made from a highly resilient photosensitive material, the recording sheet 28*a* or 28*b* might not flexibly bend enough to bring the whole respective leading edges into touch with the strike guide 40. In this case, it is possible to add a correction value to the calculated necessary transport amount to bend the recording sheet 28*a* or 28*b* sufficiently for the skew correction, wherein the correction value is determined depending upon characteristics of individual types of recording sheet, such as size and thickness.

In order to determine the first transport amount, it is necessary to detect the position of the recording sheet 28*a* or 28*b* in the main scan direction, that is, the deviation degree from the transport base center line Ca or Cb, in addition to the width of the recording sheet 28*a* or 28*b* and the skew degree of its leading edge θa and θb. For example, where the recording sheet skews counterclockwise from the transport direction, like the recording sheet 28*b* in FIG. 4, the first transport amount becomes the larger, the more the recording sheet 28*b* deviates upward in the drawing from the transport base center line Cb. On the contrary, the more the recording sheet 28*b* deviates downward in the drawing from the transport base center line Cb, the smaller the first transport amount becomes. That is to say, even through the width and skew degree of the recording sheet 28*a* or 28*b* are identical, if the deviation degree from the. transport base center lines Ca or Cb is different, the first transport amount changes.

For this reason, it is possible to arrange for example a line sensor on the paper path as a deviation detecting sensor to detect the deviation degree of the respective recording sheet 28*a* or 28*b* from the center line Ca or Cb. However, the deviation degree from the transport base center line Ca or Cb is mostly constant insofar as the mounting tolerance of the respective units and the magazines 12 and 13 inside the photo printer 10, kinds of the magazines or the characteristics of the recording sheets 28*a* and 28*b* are the same. For this reason, according to this embodiment, the deviation degrees of the recording sheets 28*a* and 28*b* sent out from the magazines 12 and 13 are previously measured on the respective lines, and the measurement results are stored as deviation degree data in the above-mentioned paper data memory 58 or the like. On correcting the skew, the first transport amount is calculated based on the deviation degree data stored in the paper data memory 58. Besides, when the magazines set in the photo printer 10 contain the recording paper of different characteristics, it is preferable to measure the deviation degree from the transport base center line Ca or Cb in accordance with the different characteristics of the recording paper.

The second transport amounts La and Lb of the recording sheets 28*a* and 28*b* are determined by these equations; La=Wa·sin(θa) and Lb=Wb·sin(θb) wherein Wa and Wb represent the widths of the recording sheets 28*a* and 28*b* extracted from the paper data memory 58. The system controller 55 calculates the necessary transport amount on each line, by summing up the calculated first and second transport amounts. It is to be noted that the necessary transport amounts on the respective lines are calculated at the same time when the leading edge of the recording sheet 28*b* conveyed behind in the drawing is detected by the photo sensor 52*a* or 52*b*. At this time, since the recording sheets 28*a* and 28*b* are nipped and conveyed by the conveyer roller pair 35,the leading edge of the forward recording sheet 28*a* is a given distance ahead from the photo sensors 51*a* and 51*b* when the leading edge of the rearward recording sheet 28*b* is detected by the photo sensor 52*a* or 52*b*. Therefore the first transport amount of the forward recording sheet 28*a* is calculated on the basis of the position where the passage or skew degree of the recording sheet 28*b* is detected.

Because the recording sheets 28*a* and 28*b* are nipped and conveyed by the same conveyer roller pair 35, the skew of the respective recording sheets 28*a* and 28*b* is corrected without fail by conveying the recording sheets 28*a* and 28*b* by the maximum necessary transport amount for the skew correction among those calculated on the respective lines. On the other hand, the recording sheets 28*a* and 28*b* might deviates in the main scan direction during the skew correction. The deviation of the sheet in the main scan direction results in displacing the image to be recorded by the exposure device 21 in the main scan direction. For this reason, it is preferable to provide a deviation degree measuring sensor or the like which measures the deviation degree in the main scan direction after correcting the skew, or calculate the deviation degree from the detected skew degrees. Based on the determined deviation degree, the exposure device 21 can adjust the recording position of the image in the main scan direction.

Next, the operations of the photo printer 10 of this structure will be explained while referring to FIGS. 1, 2, 5, 6, 7 and 8.

FIGS. 5, 6, 7 and 8 are schematic top plan and side views illustrating the interior of the skew corrector 19. A user inputs the magazine identifying data on the respective magazines 12 and 13 through the control panel 59 ahead of a print order. The system controller 55 reads the widths of the recording sheets 28*a* and 28*b* from the data table in the paper data memory 58. Upon the print order being input by the user, the photosensitive recording papers 24 are sent out from the recording paper rolls 25 of the magazines 12 and 13 which are placed apart from each other in an axial direction of the paper rolls 25. The cutters 15 and 16 cut the recording paper 24 into the recording sheets 28*a* and 28*b* of a given length. After being sent out from the respective magazines 12 and 13, the recording sheets 28*a* and 28*b* are conveyed by the conveyer roller pairs 30 in two parallel lines to the back-printing device 18 where the necessary information including the film ID and the frame serial number are printed on the backsides of the recording sheets 28*a* and 28*b*.

Figure 5A:
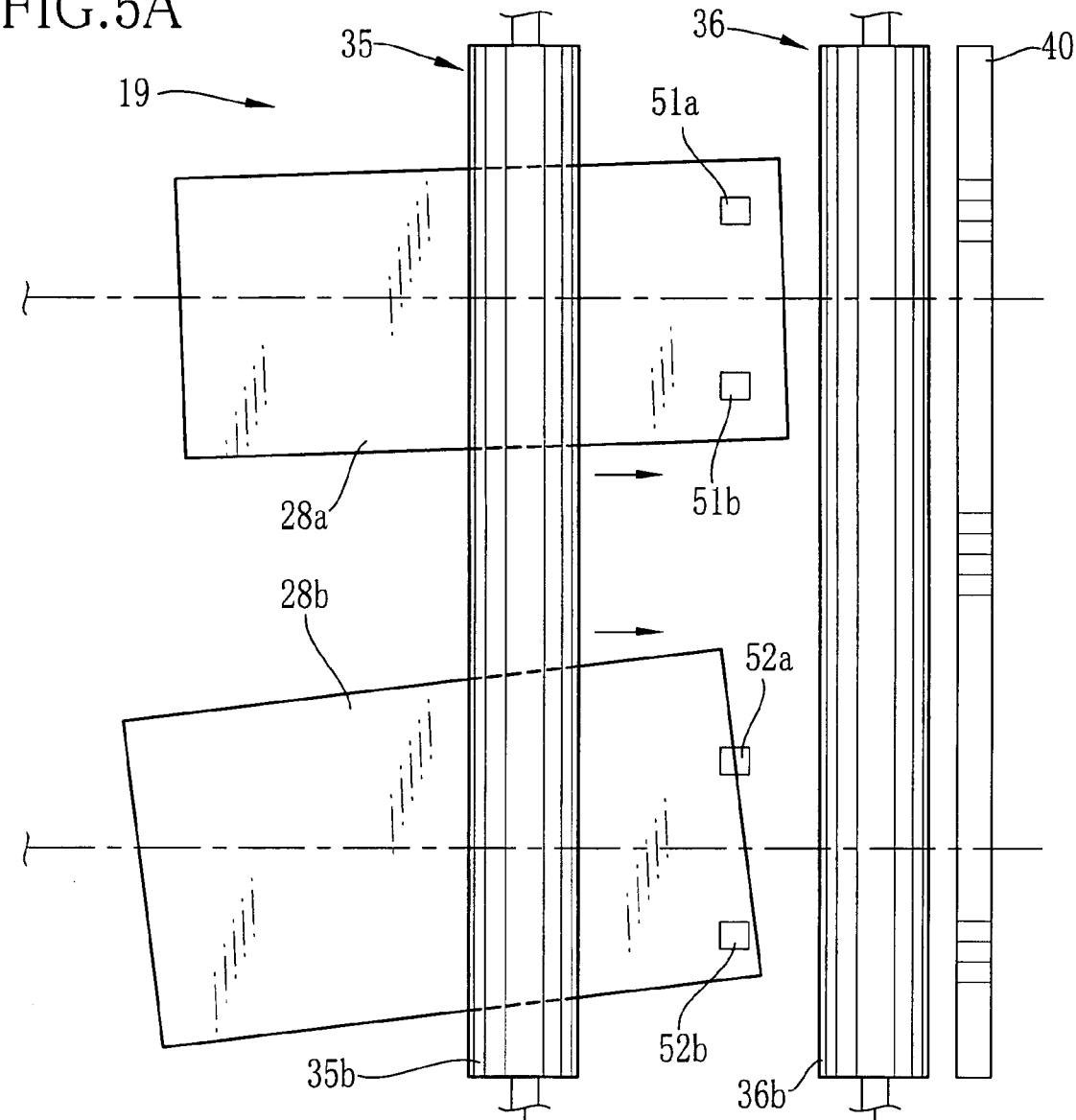
FIGS. 5A and 5B are schematic top plan and side views respectively illustrating the skew corrector of FIG. 2 in a state when passage of leading edges of the respective recording sheets is detected.
Figure 5B:
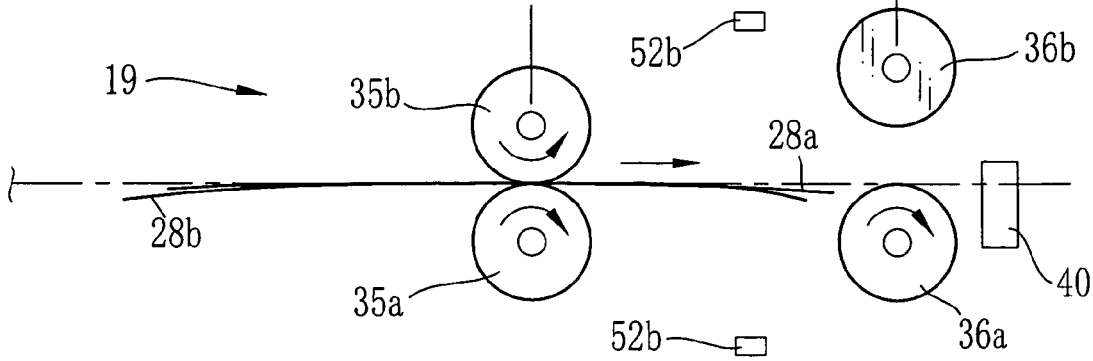

The back-printed recording sheets 28*a* and 28*b* are conveyed to the skew corrector 19 by the conveyer roller pairs 31. In this example, the recording sheet 28*b* is more heavily skewed than the recording sheet 28*a* and is conveyed behind. In an initial state of the skew corrector 19, that is before the recording sheets 28*a* and 28*b* come, the first nip roller 35*b* is in the nip position, the second nip roller 36*b* in the release position, and the strike guide 40 in the protruded position as shown in FIG. 2. As shown in FIG. 5, the leading edge of the recording sheet 28*a* first passes the photo sensors 51*a* and 51*b*. The system controller 55 detects the skew degree of the recording sheet 28*a* from a difference between the time when the forward recording sheet 28*a* passes by the photo sensor 51*a* and the time when the forward recording sheet 28*a* passes by the photo sensor 51*b*. Next the leading edge of the recording sheet 28*b* also passes the photo sensors 52*a* and 52*b* and the skew degree of the recording sheet 28*b* is detected in the same way.

After detecting the skew degree of the rearward recording sheet 28*b*, the system controller 55 calculates the necessary transport amounts on the respective lines from the widths of the recording sheets 28*a* and 28*b*, their skew degrees and the previously measured deviation degrees from the transport base center lines Ca and Cb. Furthermore, the system controller 55 controls the first conveyer roller pair 35 so as to convey the recording sheets 28*a* and 28*b* by the maximum necessary transport amount among the calculated ones.

Figure 6A:
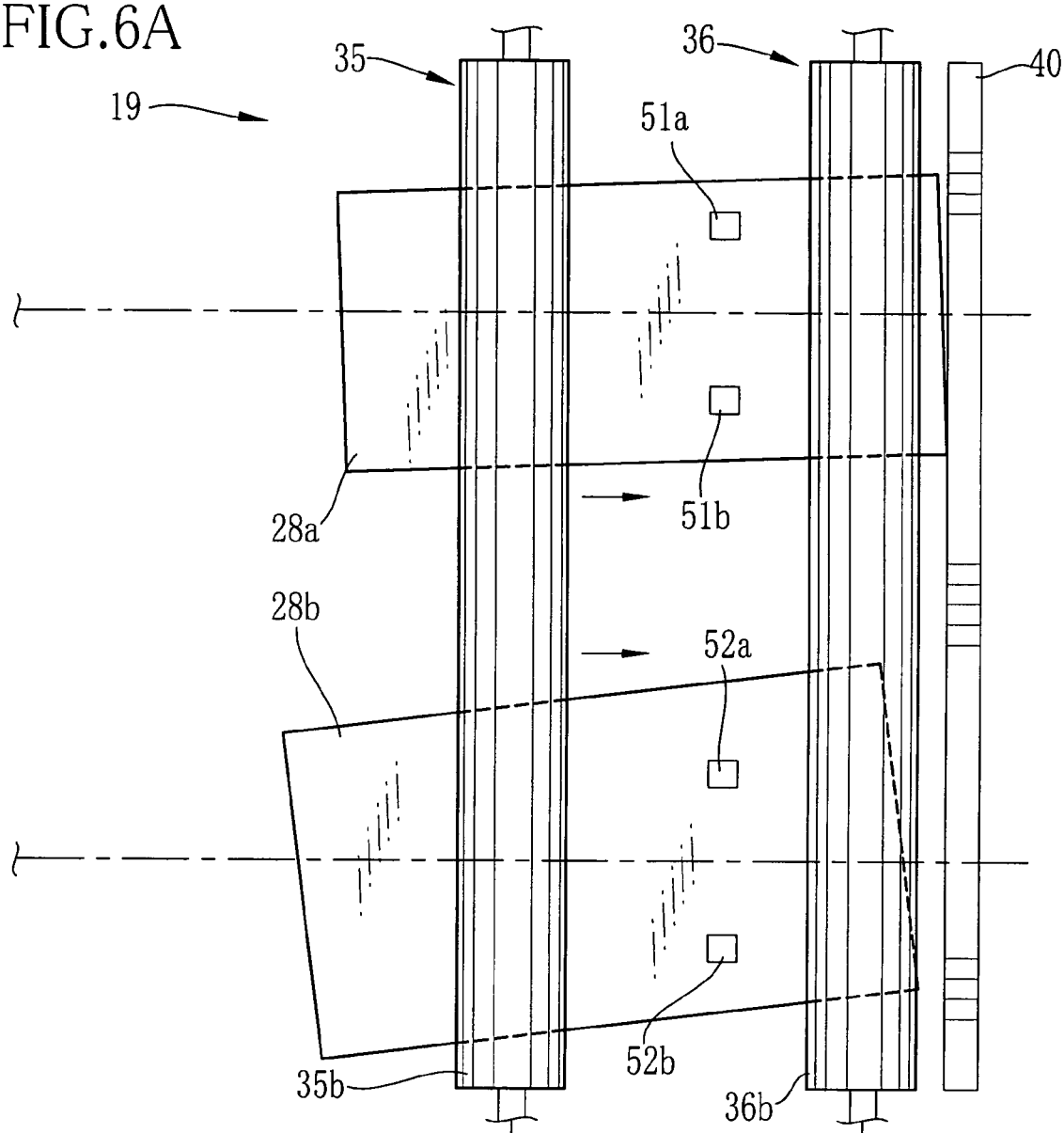
FIGS. 6A and 6B are schematic top plan and side views respectively illustrating the skew corrector of FIG. 2 in a state where the leading edge of foregoing one of the recording sheets strikes on a strike guide.
Figure 6B:
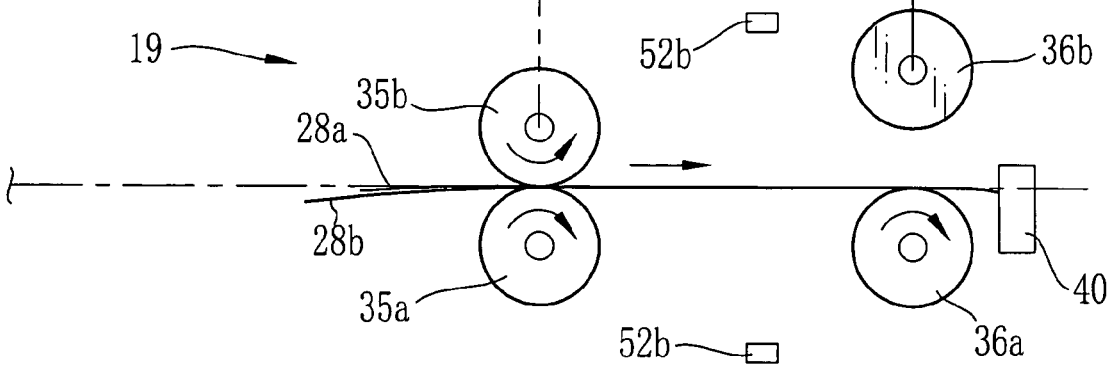

The recording sheets 28*a* and 28*b* are conveyed to the strike guide 40 by the first conveyer roller pair 35. At this time, the second capstan roller 36*a* is rotated at the same speed as the first capstan roller 35*a* so as not to give load on the conveyed recording sheets 28*a* and 28*b*. When one corner of the recording sheet 28*a* comes into contact with the strike guide 40, as shown in FIG. 6, the recording sheet 28*a* staffs bending. Next, one corner of the other recording sheet 28*b* also comes into contact with the strike guide 40 and then the recording sheet 28*b* staffs bending flexibly. Since the first conveyer roller pair 35 continues to convey the recording sheets 28*a* and 28*b* by their calculated maximum necessary transport amount, the recording sheets 28*a* and 28*b* are bent sufficiently enough to let the whole leading edges of both recording sheets 28*a* and 28*b* strike on the strike guide 40 and thus correct the skew of the leading edges. At the same time, the positions of the leading edges of the recording sheets 28*a* and 28*b* are aligned.

Figure 7A:
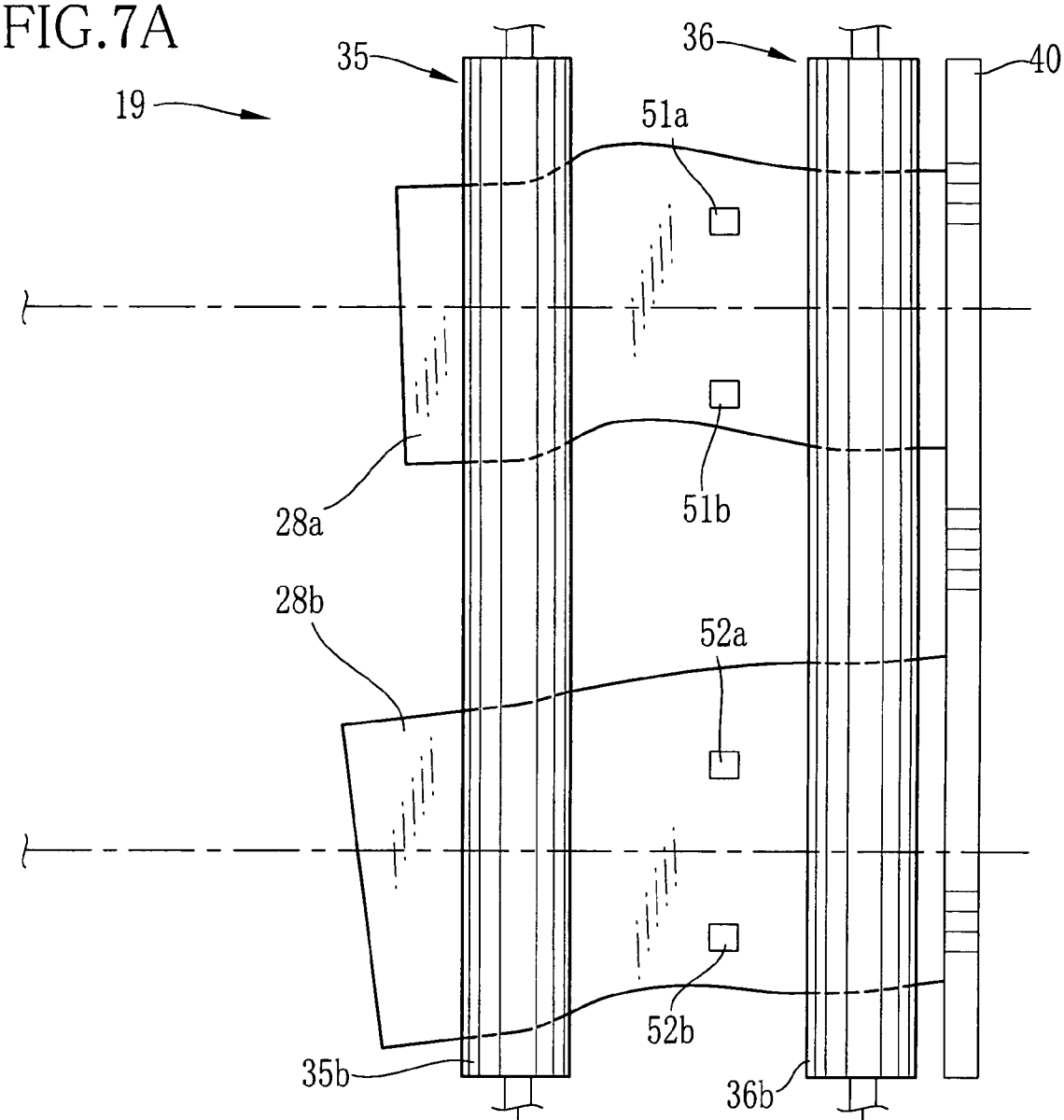
FIGS. 7A and 7B are schematic top plan and side views respectively illustrating the skew corrector of FIG. 2 in a state where skew of the leading edges of the respective recording sheets is corrected.
Figure 7B:
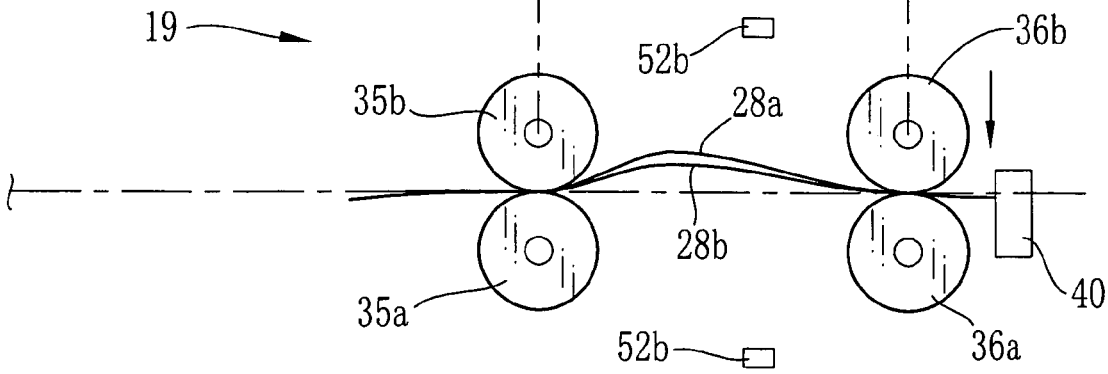
Figure 8A:
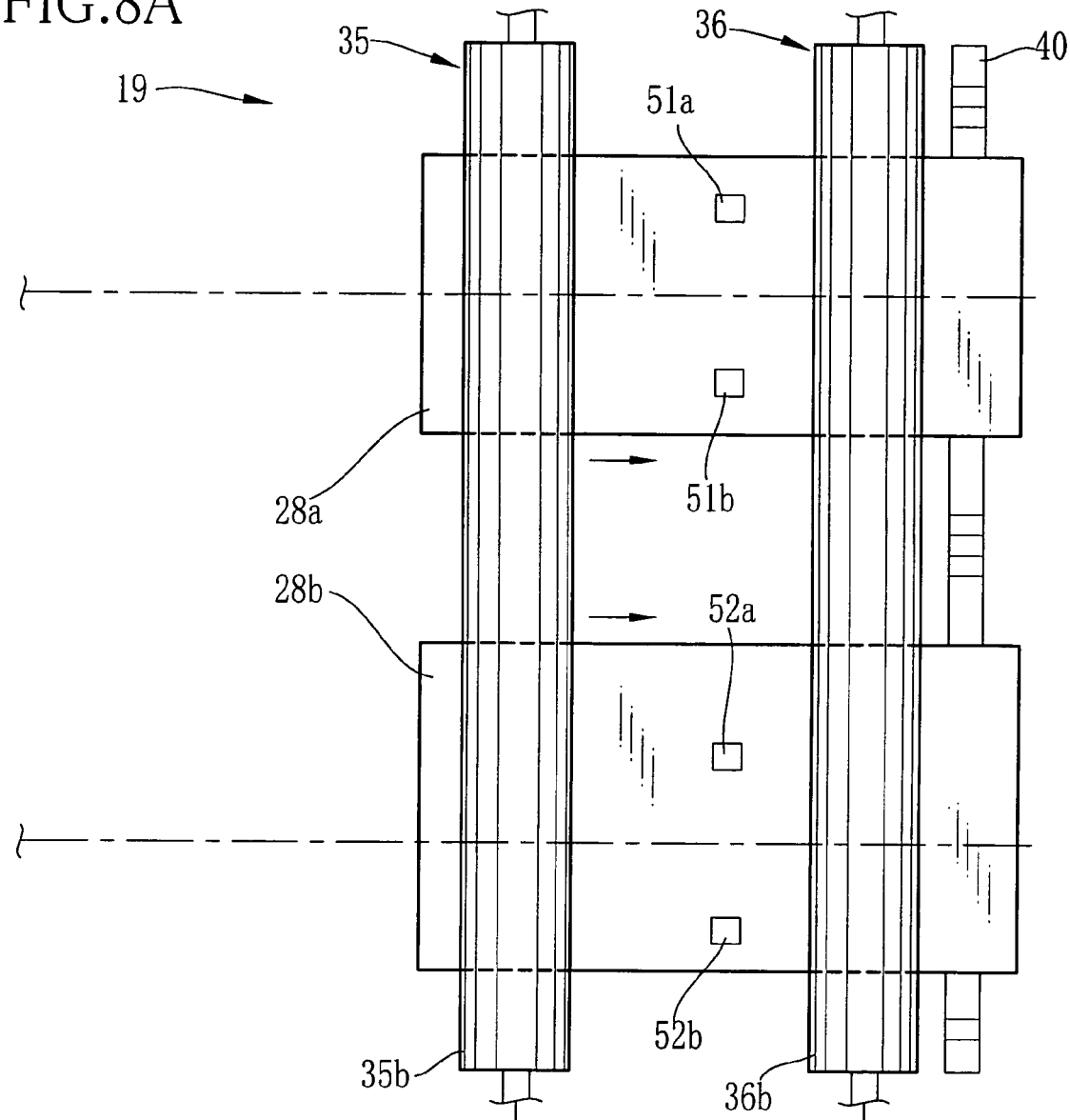
FIGS. 8A and 8B are schematic top plan and side views respectively illustrating the skew corrector of FIG. 2 in a state where the skew of the respective recording sheets is corrected.
Figure 8B:
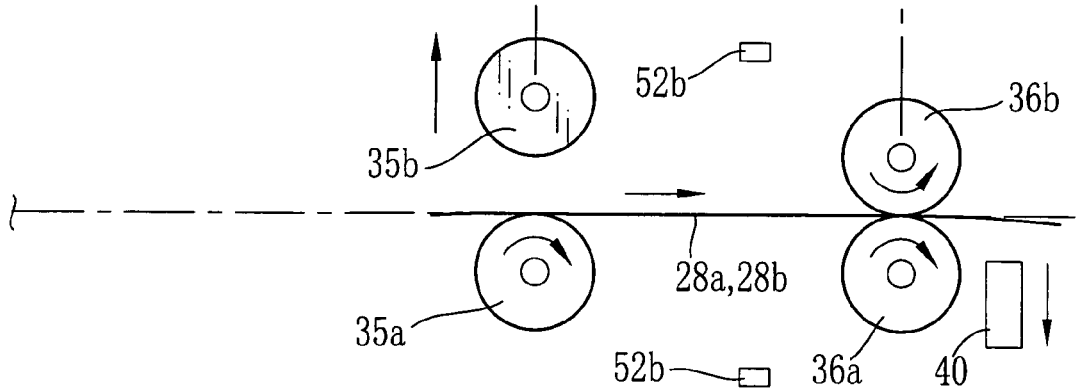

After conveying the recording sheets 28 by the calculated maximum necessary transport amount, the system controller 55 stops rotating the first and second capstan rollers 35*a* and 36*a* and then moves the second nip roller 36*b* to the nip position as shown in FIG. 7B. Thereafter, the system controller 55 moves the first nip roller 35*b* to the release position, as shown in FIG. 8B, to release the bend formed in the recording sheets 28*a* and 28*b*, and then moves the strike guide 40 to the retreat position. When the movement of the strike guide 40 to the retreat position is completed, the second conveyer roller pair 36 starts to convey the recording sheets 28*a* and 28*b*. Because the first conveyer roller pair 35 is released, the skew of the whole recording sheets 28*a* and 28*b* is corrected as shown in FIG. 8A. At this time, the first capstan roller 35*a* is also rotated at the same speed as the second capstan roller 36*a*. Because it just needs to convey the recording sheet 28*b* whose leading edge comes the most behind by the maximum necessary transport amount among the calculated ones, the skew of the parallel-conveyed recording sheets 28*a* and 28*b* is corrected in a short time and without fail.

After the skew is corrected and the leading edges are aligned, the recording sheets 28*a* and 28*b* are conveyed by the conveyer roller pairs 31 through the exposure device 21 where the recording sheets 28*a* and 28*b* are exposed simultaneously to record images thereon respectively. The exposed recording sheets 28*a* and 28*b* are conveyed to the developing section 22, to be processed for color development, bleach-fixing, washing and drying, and then are sent as photo prints to the outside of the photo printer 10.

Figure 9A:
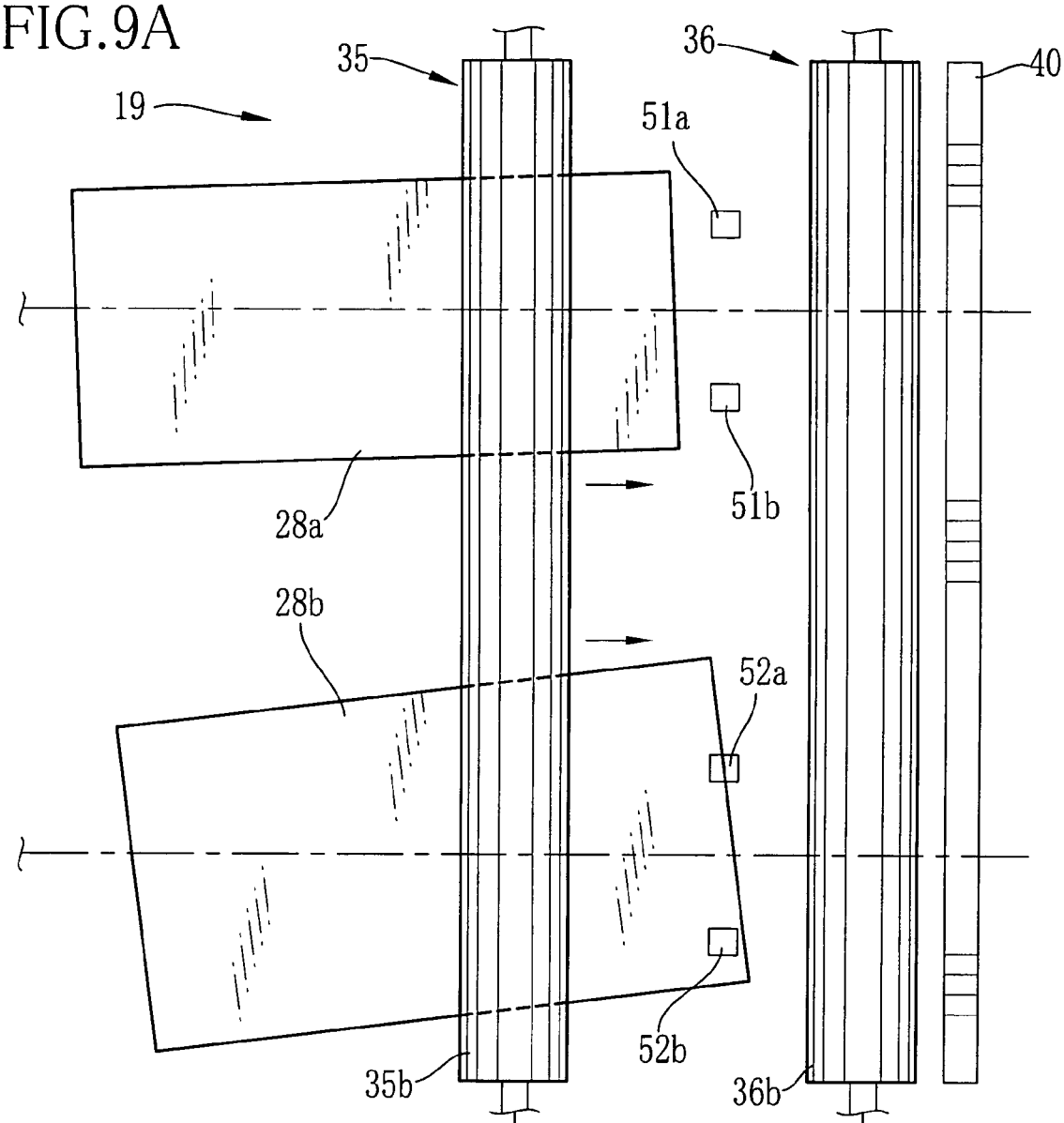
FIGS. 9A and 9B are schematic top plan and side views respectively illustrating the skew corrector of FIG. 2 in a state where a heavily skewed recording sheet is conveyed forward.
Figure 9B:
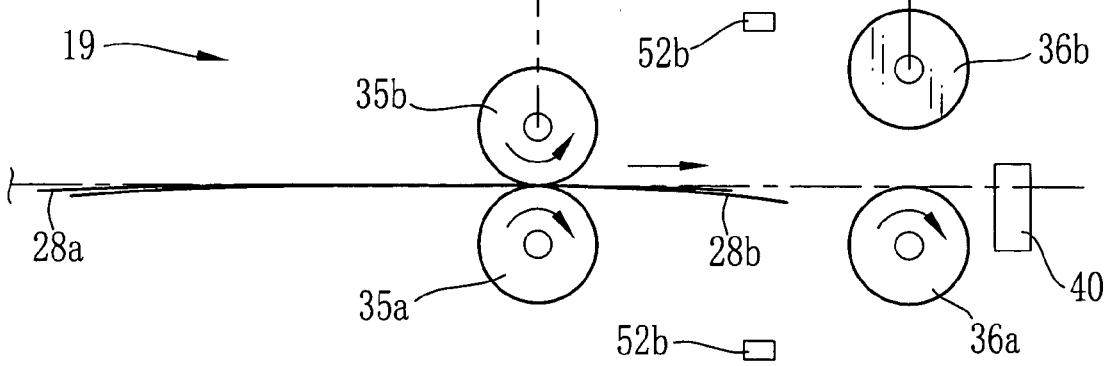

In the example illustrated in FIGS. 5 to 8, the heavily skewed recording sheet 28*b* is conveyed behind the recording sheet 28*a*. As shown for example in FIG. 9, however, even if the heavily skewed recording sheet 28*b* is conveyed ahead the recording sheet 28*a*, the skew of the respective recording sheets 28*a* and 28*b* is also corrected in the same way. In this case, the skew degree of the recording sheet 28*b* is detected before that of the recording sheet 28*a*. After detecting the skew degree of the recording sheet 28*a*, the system controller 55 calculates the necessary transport amount on each line in the same way as the above example. Then the system controller 55 controls the first conveyer roller pair 35 so that the recording sheets 28*a* and 28*b* are conveyed by the maximum necessary transport amount among the calculated ones. Therefore, the skew corrector 19 can correct the skew of the recording sheets 28*a* and 28*b* regardless of the difference in skew degree between the recording sheets 28*a* and 28*b* or of the difference between their leading edge positions.

Figure 10:
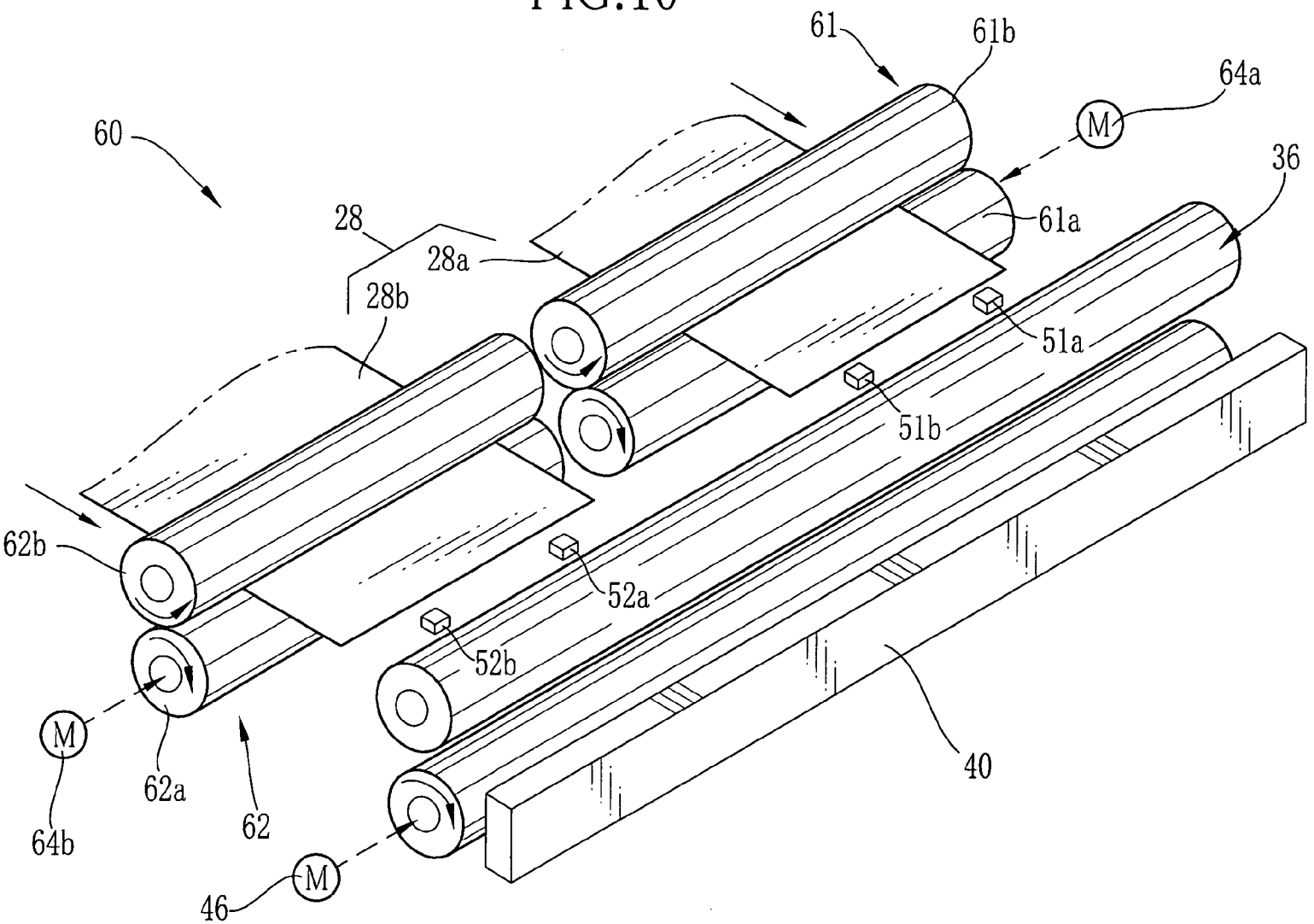
FIG. 10 is a schematic perspective view illustrating the interior of a skew corrector according to a second embodiment.

In the above described embodiment, the first conveyer roller pair 35 of the skew corrector 19 nips and conveys the recording sheets 28*a* and 28*b* simultaneously in two lines. As shown in FIG. 10, however, instead of the first conveyer roller pair 35, it is possible to appose separate conveyer roller pairs to convey the recording sheets 28*a* and 28*b* individually.

Now the second embodiment that apposes conveyer roller pairs will be explained.

As shown in FIG. 10, a skew corrector 60 has basically the same structure as the skew corrector 19 except that two conveyer roller pairs 61 and 62 are apposed to convey recording sheets 28*a* and 28*b* separately. The explanation on the same or equivalent members will be omitted, designating them by the same numbers as the above embodiment. Furthermore, transport guides 37 and 38, a guide shift mechanism 50, a system controller 55, a paper data memory 58, a control panel 59 and other equivalent members are omitted from FIG. 10.

Capstan rollers 61*a* and 62*a* of the conveyer roller pairs 61 and 62 are rotated by feed motors 64*a* and 64*b* respectively. And nip rollers 61*b* and 62*b* of the conveyer roller pairs 61 and 62 are respectively connected to not-shown shift mechanisms, so that the nip rollers 61*b* and 62*b* are individually movable between the nip position and release position in the same way as set forth above. Because the conveyer roller pairs 61 and 62 are rotated by the different feed motors 64*a* and 64*b*, it is possible to control respective transport speeds of the recording sheets 28*a* and 28*b* at different speeds. Therefore the skew corrector 60 corrects the skew in a short time by speeding up the transport speed of such a recording sheet 28 whose necessary transport amount calculated at the detection of its leading edge is the largest among any other recording sheets 28.

Figure 11A:
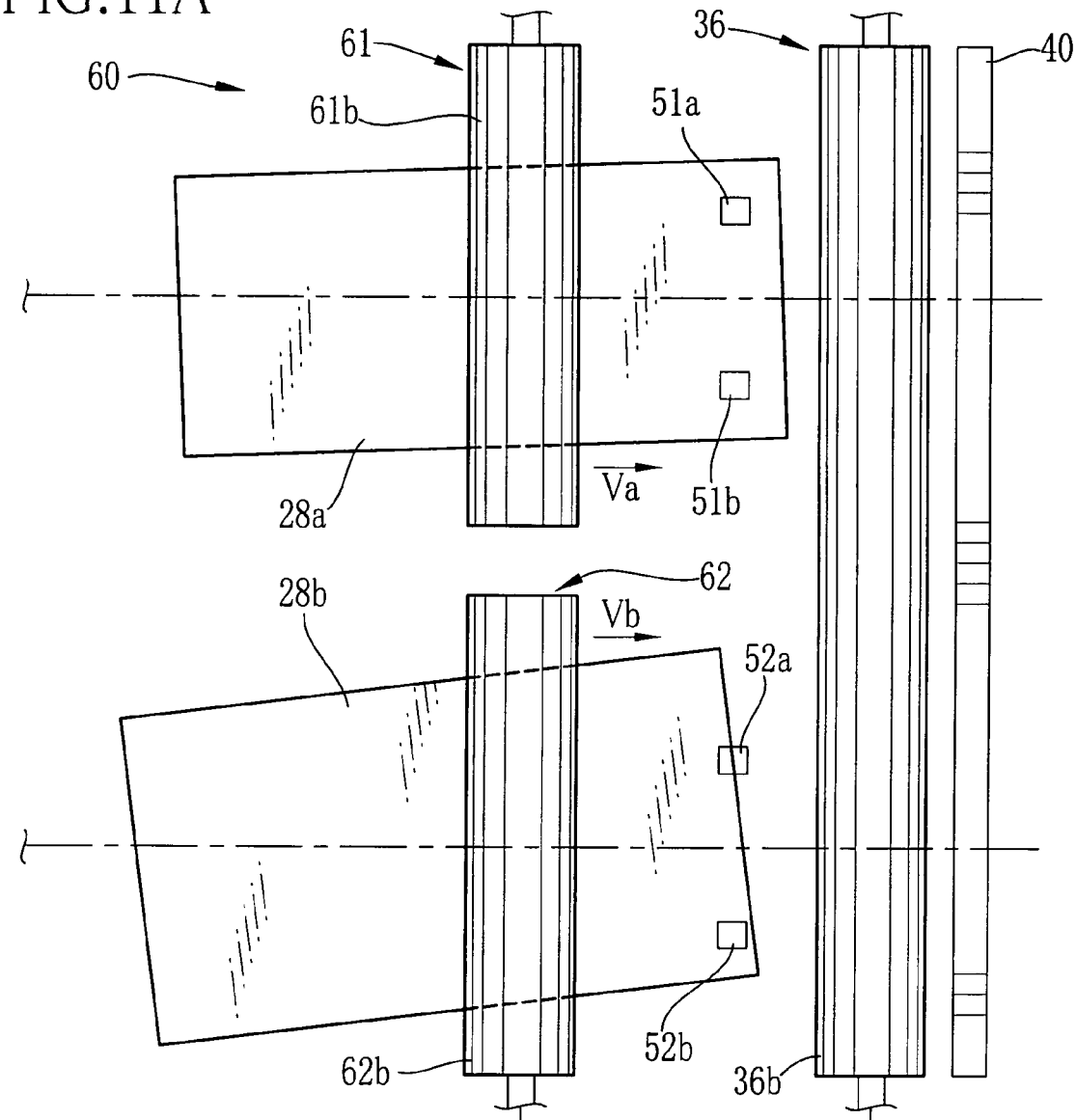
FIGS. 11A and 11B are schematic top plan and side views illustrating the skew corrector according to the second embodiment in a state when a passage of the leading edges of the respective recording sheets is detected.
Figure 11B:
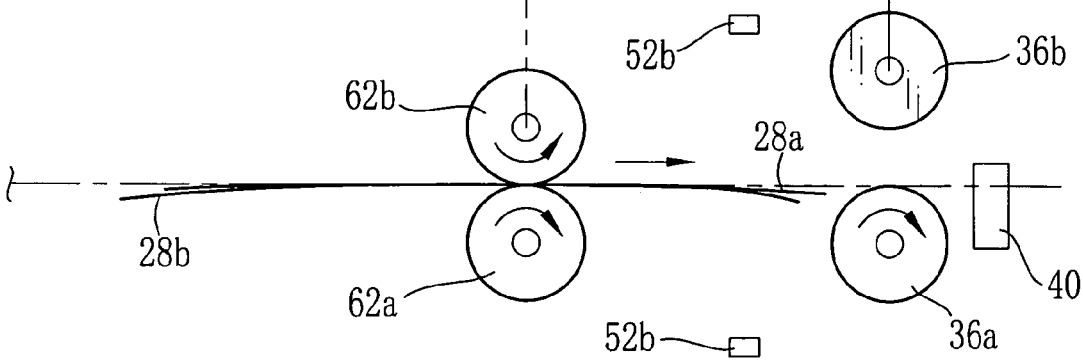

Now the operations of the skew corrector 60 in correcting the skew will be explained while referring to FIGS. 11 and 12, wherein the description about the operations till the necessary transport amount is calculated on every line will be omitted because these operations are the same as the above-mentioned skew corrector 19. In FIG. 11, the recording sheet 28*b* is more heavily skewed and is conveyed behind as compared to the recording sheet 28*a*.

As shown in FIG. 11, when a skew degree of the recording sheet 28*b* whose leading edge comes later is detected, a system controller 55 starts calculating the necessary transport amount on every line from the width and the skew degree of the individual recording sheet 28*a* or 28*b*. The system controller 55 controls rotational speeds of the feed motors 64*a* and 64*b* such that a transport speed Vb of the recording sheet 28*b* whose necessary transport amount is calculated to be the largest is set higher than a transport speed Va of the other recording sheet 28*a*. The transport speed Vb of the recording sheet 28*b* can be any speed insofar as it is higher than the transport speed Va of the recording sheet 28*a*. However, it is possible to calculate a time required for skew correction from the necessary transport amount and the transport speed Va of the recording sheet 28*a*, and set the speeds Va and Vb based on the calculated time so as to finish the skew correction of the leading edge of the recording sheet 28*b* at almost the same time as the leading edge of the recording sheet 28*a*.

Figure 12A:
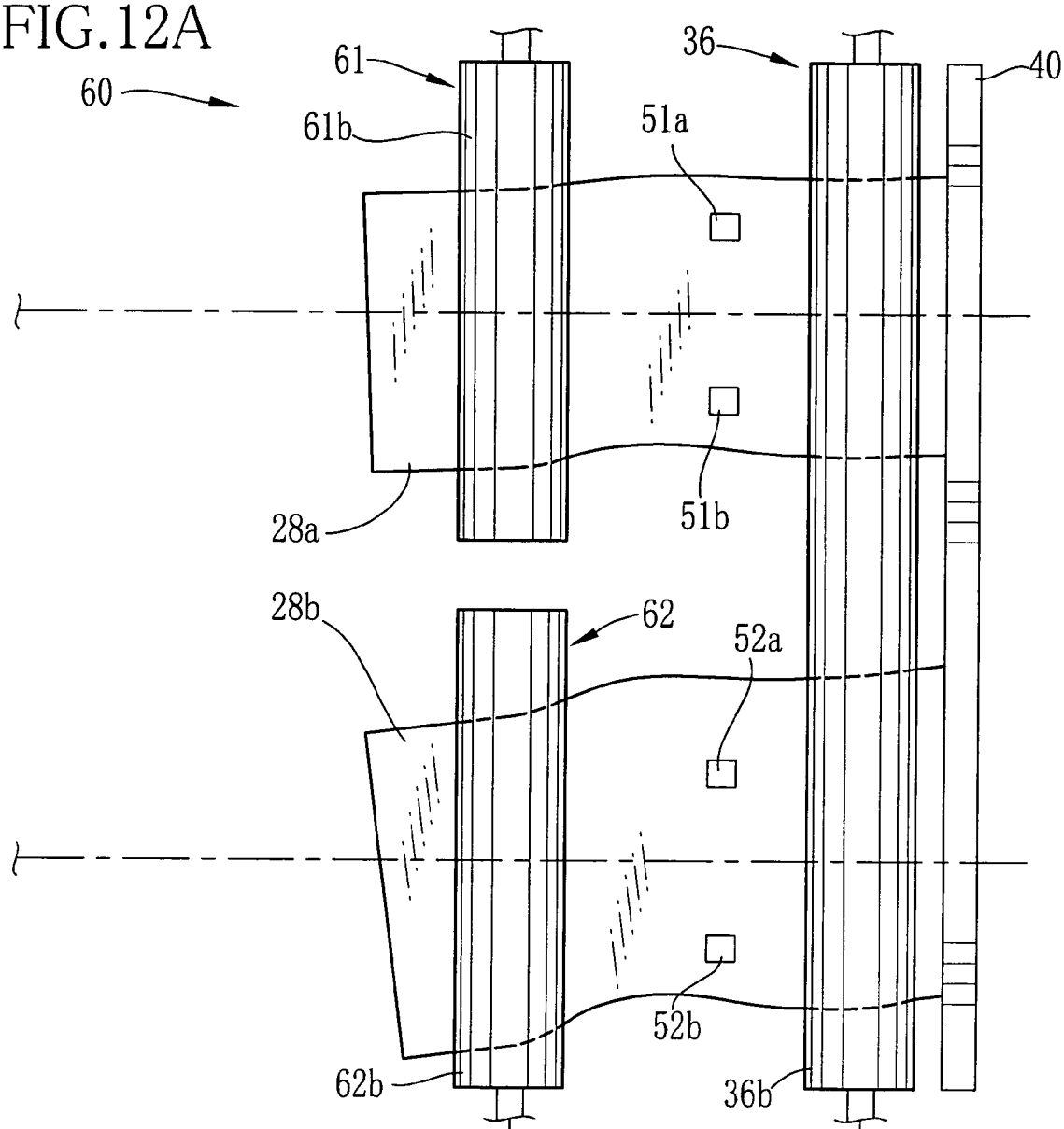
FIGS. 12A and 12B are schematic top plan and side views respectively illustrating the skew corrector according to the second embodiment in a state when the skew of the leading edges of the respective recording sheets is corrected.

Thus, the recording sheets 28*a* and 28*b* are conveyed by the conveyer roller pairs 61 and 62 at the different transport speeds to a strike guide 40. When one corner of the recording sheet 28*a* or 28*b* comes to contact with the strike guide 40, the recording sheet 28*a* or 28*b* starts being bent respectively. Since the respective conveyer roller pairs 61 and 62 continue to convey the recording sheets 28*a* and 28*b* by the separately calculated necessary transport amounts, the both recording sheets 28*a* and 28*b* flexibly bend sufficiently. As a result, the whole leading edges of the recording sheets 28*a* and 28*b* are brought into touch with the strike guide 40, so the skew of each leading edge is corrected, as shown in FIG. 12A. It is possible to correct the skew in a shorter time by speeding up the transport speed Vb of the recording sheet 28*b* whose necessary transport amount is the largest. From then on, the operations are the same as the above-mentioned skew corrector 19.

Figure 12B:
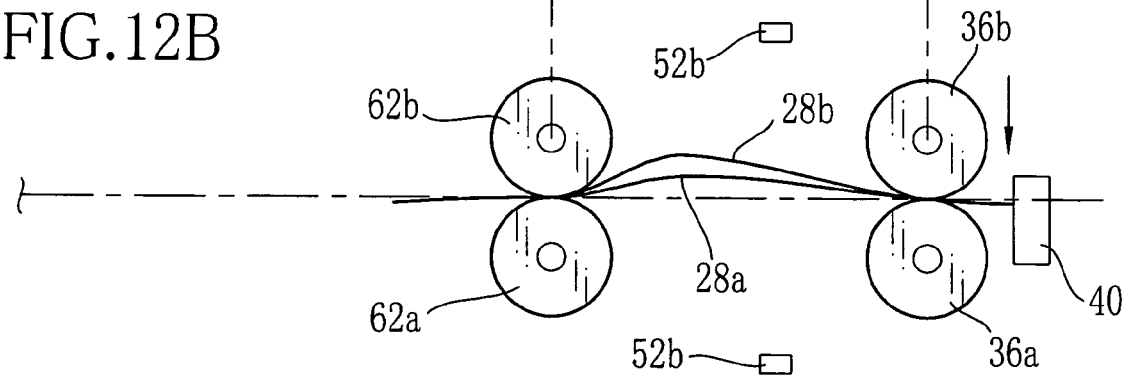

FIGS. 11 and 12 explain a case that the heavily skewed recording sheet 28*b* is conveyed behind the recording sheet 28*a*. Even if the heavily skewed recording sheet 28*b* is conveyed ahead the recording sheet 28*a*, the skew of the respective recording sheets 28*a* and 28*b* is corrected in a shorter time by speeding up the transport speed of the recording sheet 28 whose calculated necessary transport amount is the largest, in comparison with the transport speed of any other recording sheets 28. When the width and skew degree of the recording sheets 28*a* and 28*b* are the same but their leading edges deviate, the skew is also corrected in a short time by speeding up the transport speed of the most rearward recording sheet 28. Therefore, the skew corrector 60 can correct the skew of the recording sheets 28*a* and 28*b* regardless of the difference in the skew degree of the recording sheets 28*a* and 28*b* or in the deviation degree of their leading edges as well.

The above-mentioned skew correctors 19 and 60 determine the skew degree of the respective recording sheets 28*a* and 28*b* by placing photo sensors 51*a* and 51*b* or 52*a* and 52*b* on every line of the recording sheets 28. However the present invention is not limited to this configuration. Like the above-mentioned deviation degree from transport base center lines Ca and Cb, the skew degree of the recording sheet 28 is mostly constant insofar as mounting tolerances of units and magazines 12 and 13 in a photo printer 10, kinds and set positions of the magazines 12 and 13, and characteristics of the recording sheets 28*a* and 28*b* are not changed. Therefore, it is possible to measure the skew degree on each line by making a test print each time the kind or the set position of the magazine 12 or 13, or the characteristics of the recording sheet 28*a* or 28*b* is changed. Measurement results of the test print are input as skew degree data through a control panel 59. In this case, because it is merely necessary to detect the passage of the recording sheets 28*a* and 28*b*, every line needs only one photo sensor.

Instead of making the test print every time the kinds of the magazine 12 or 13 or the characteristics of the recording sheet 28*a* or 28*b* is changed, it is possible to prepare a second data table that correlates the kinds of the magazines 12 and 13 and the characteristics of the recording paper rolls 25 contained in the magazine 12 and 13 with the skew degree measurement data of the recording sheets 28*a* and 28*b*, and store the second data table in a paper data memory 58 or the like. In this case, a user inputs magazine identifying data and paper data including the characteristics of the recording sheets 28*a* and 28*b* for example through the control panel 59. Instead of inputting the magazine identifying data and the paper data through the control panel 59, it is possible to provide the magazines 12 and 13 with bar codes representative of the magazine identifying data and the paper data and to read the stored data from the bar code when setting the magazines 12 and 13. In addition, instead of the bar codes, it is possible to provide the magazines 12 and 13 with an IC chip each, which stores the magazine identifying data and the paper data.

The system controller 55 can determine the skew degree on every line by extracting corresponding skew degree measurement data from the second data table in the paper data memory 58 based on the magazine identifying data and paper data of the recording sheet 28. As parameters to be associated with the magazine identifying data in the second data table, it is possible to add the set positions of the magazines 12 and 13. For example, the set position data include data as whether the magazine 12 or 13 is placed in an upper position or a lower position in the photo printer 10, or how apart the magazines 12 and 13 are spaced from each other in a width direction of the recording paper 24, i.e. an axial direction of each paper roll 25.

In the illustrated embodiment, the leading edge of the recording sheet 28 is struck on the strike guide 40 in order to flexibly bend the recording sheet 28 for correcting the skew. It is alternatively possible to omit the strike guide 40 and let the leading edges of the recording sheets 28 strike on the second conveyer roller pair 36 instead, while the second conveyer roller pair 36 stops rotating in its nip position. In that case, after the recording sheet 28 is conveyed the maximum necessary transport amount by driving the first conveyer roller pair 36, the first conveyer roller pair 35 is switched from its nip position to its release position, and the second conveyer roller pair 36 starts being driven to convey the recording sheet 28. The same applies to the embodiment using the conveyer roller pairs 61 and 62 in the skew corrector 60.

In addition, instead of the conveyer roller pairs 35, 61, and 62, it is possible to use a movable nip member to convey the recording sheets 28 in plural lines, the movable nip member being movable in a direction parallel to a sub scan direction while nipping the recording sheets 28*a* and 28*b*. In using such a movable nip member, the above-mentioned necessary transport amount may correspond to the amount of movement of the movable nip member, and the above-mentioned transport speed corresponds to the speed of movement of the movable nip member.

Figure 13A:
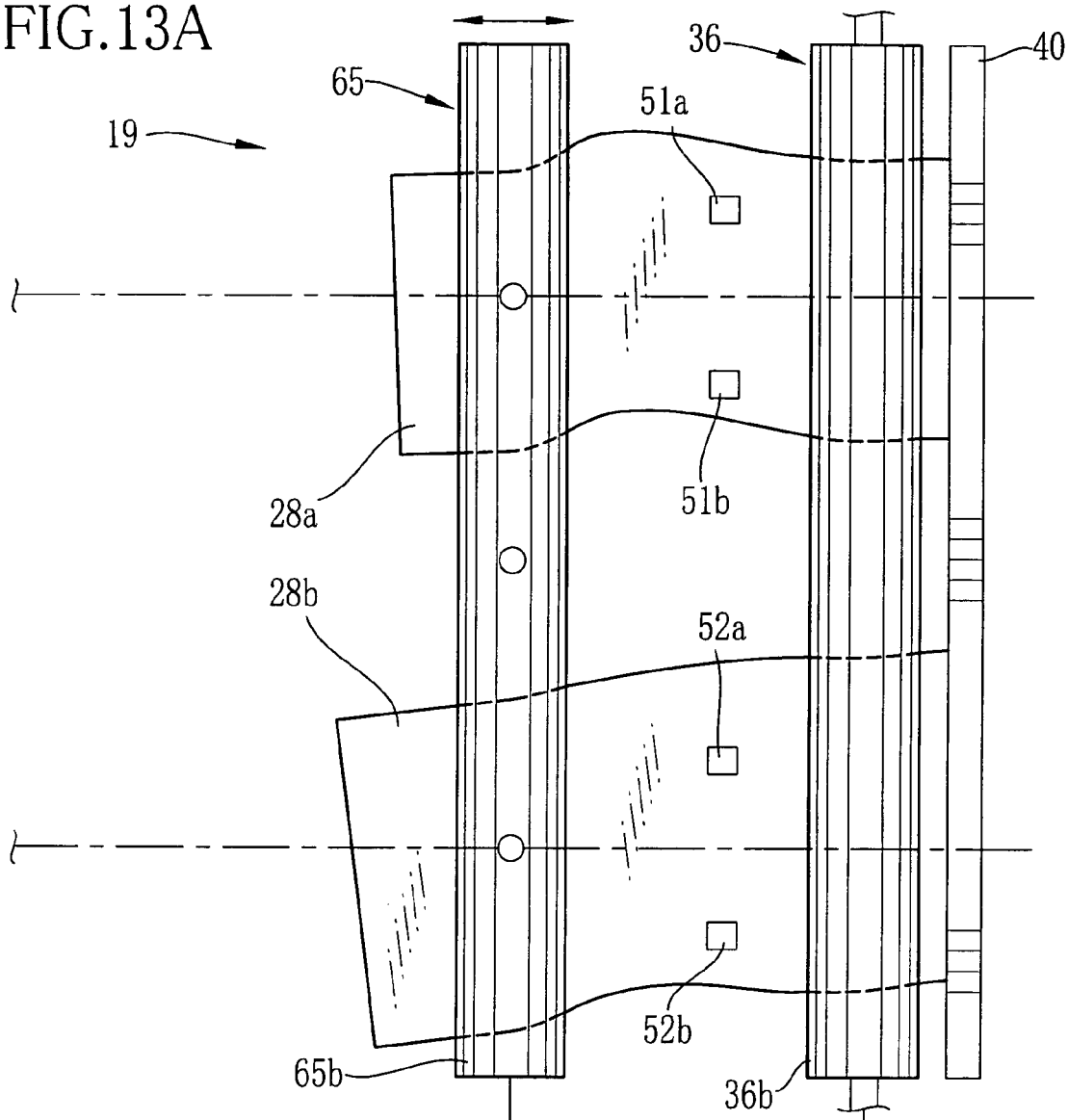
FIGS. 13A and 13B are schematic top plan and side views respectively illustrating a skew corrector according to a third embodiment.
Figure 13B:
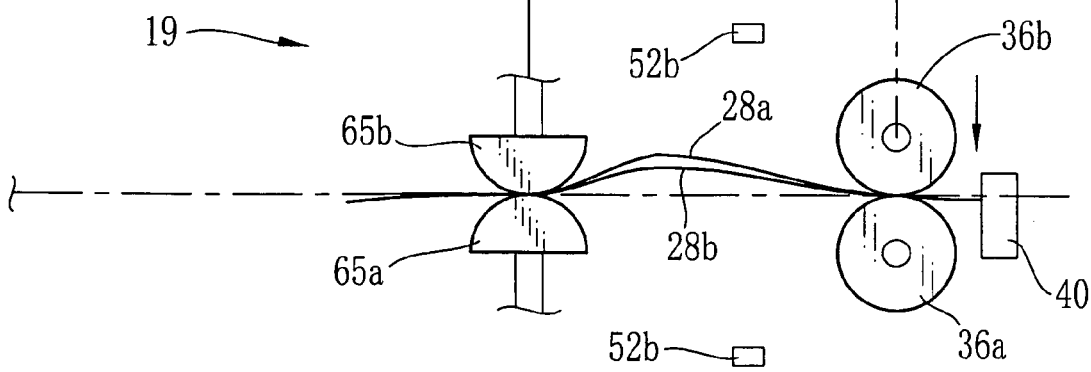

For example, as shown in FIGS. 13A and 13B, instead of the first conveyer roller pair 35 used in the first embodiment shown FIG. 2, it is possible to use a movable nip member 65. The movable nip member 65 consist of a bearing member 65*a* to support recording sheets 28*a* and 28*b* from their backsides (downside in the drawing) and a nipping member 65*b* which can nip the recording sheets 28*a* and 28*b* with the bearing member 65*a*. The nipping member 65*b* is movable between a nip position to nip the recording sheets 28*a* and 28*b* and a retreat position to retreat upward from the nip position in the drawing. The movable nip member 65 is also movable in parallel to the transport direction of the recording sheets 28 while nipping the recording sheets 28*a* and 28*b*. Therefore, it is possible to gain the same effect as using the first conveyer roller pair 35 by moving the movable nip member 65 nipping the recording sheets 28*a* and 28*b* by the largest necessary transport amount among those calculated on the respective lines.

Figure 14A:
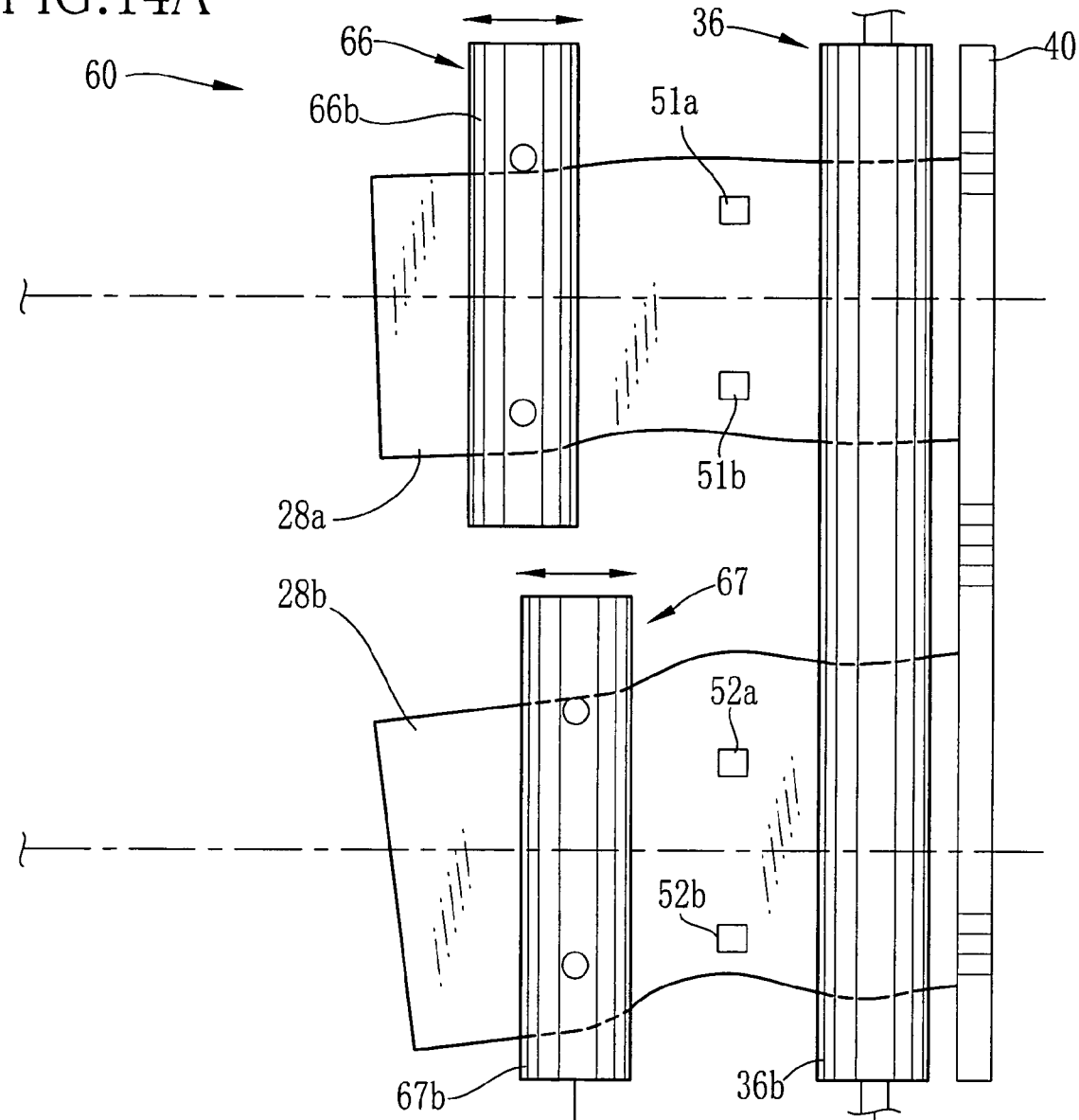
FIGS. 14A and 14B are schematic top plan and side views respectively illustrating a skew corrector according to a forth embodiment.
Figure 14B:
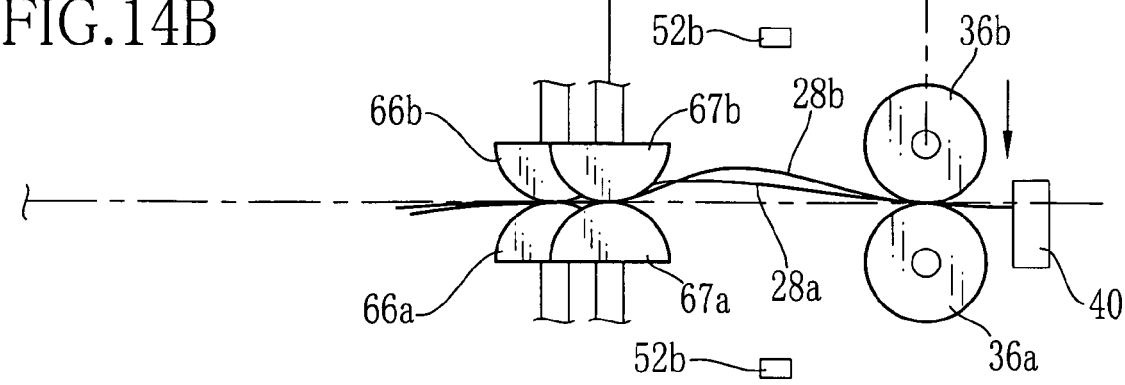

Furthermore, as shown in FIGS. 14A and 14B, it is possible to use two pairs of movable nip members 66 and 67 instead of the conveyer roller pairs 61 and 62 shown in FIG. 10. Each of the movable nip members 66 and 67 consists of a bearing member 66*a* or 67*a* and a nipping member 66*b* or 67*b*, having basically the same structure as the above-mentioned movable nip member 65. The movable nip members 66 and 67 are respectively movable in a direction parallel to a transport direction. Therefore, it is possible to gain the same effect as using the separate conveyer roller pairs 61 and 62 by speeding up the movable nip member whose necessary amount of movement is calculated to be the largest.

In the above described embodiment, the magazines 12 and 13 are arranged in a vertical direction in the drawings. However instead of the illustrated layout, it is possible to appose them in a width direction of the recording sheet 28.

It is also possible to set plural recording paper rolls 25 in the same magazine instead of arranging two magazines. Where only one magazine is loadable but recording sheets of the same width are to be conveyed in plural lines, it is possible dispose a not-shown distributing device which distributes the recording sheets 28 into plural lines by displacing them in its width direction before the skew corrector 19.

In the above described embodiment, the photo printer 10 conveys the recording sheets 28*a* and 28*b* in two lines but the number of lines is not limited, but it is possible to provide more than two lines to convey the recording sheets 28. In this case, the number of photo sensors are increased correspondingly to the number of added lines, as well as the axial lengths of the first and second conveyer roller pairs 35 and 36 are changed to be suitable for the line number of the recording sheet 28. Moreover, in order to convey the recording sheets 28 in more than two lines in the skew corrector 60 described in the second embodiment, a corresponding number of conveyer roller pairs to the line number are disposed in addition to the conveyer roller pairs 66 and 67.

As described so far, the present invention is not to be limited to the above embodiments but, on the contrary, various modifications will be possible without departing from the scope of claims appended hereto.

What is claimed is:

1. A conveyer comprising:

a conveying device for conveying plural sheets in parallel lines along a transport path;

a strike member placed at a downstream position of said conveying device;

detectors for detecting a leading edge of each of said sheets on each line; and a control device that calculates, based on respective widths and skew degrees of said sheets, transport amounts necessary for letting the whole leading edges of said sheets of respective lines strike on said strike member, and drives said conveying device to convey said sheets by the largest one of said calculated transport amounts so that said sheets strike at their leading edges on said strike member and are bent flexibly, thereby to correct their skew, wherein said detectors include a plurality of sensors, arranged for each line in a direction orthogonal to said transport path, to detect skew degree, of each sheet on each line, from a difference in detection time of the leading edge of said sheet between said sensors of the same line.

2. A conveyer as claimed in claim 1, wherein said control device calculates said transport amounts for the respective lines based on positions of said sheets on the respective lines at a time when one of said detectors detect a leading edge of the latest one of said sheets.

3. A conveyer as claimed in claim 1, wherein said strike member comprises a pair of conveyer rollers stopping at the downstream position of said conveying device, said conveyer roller pair being driven to convey said sheets in said parallel lines after the skew is corrected.

4. A conveyer as claimed in claim 3, wherein said conveying device may be switched over between a nip position to nip said sheets and a release position to release said sheets, and said control device drives said conveying device in said nip position to convey said sheets by the largest transport amounts and, thereafter, switches said conveying device to said release position and drives said conveyer roller pair to start conveying said sheets in said parallel lines.

5. A conveyer as claimed in claim 1, further comprising a conveyer roller pair placed between said conveying device and said strike member, said conveyer roller pair being able to switch over between a nip position to nip said sheets and a release position to release said sheet, said conveyer roller pair being kept in said release position while said leading edges of said sheets as conveyed by said conveying device are passing through said conveyer roller pair.

6. A conveyer as claimed in claim 5, wherein said conveying device is able to switch over between said nip position and said release position, and said strike member is movable between a protruded position to protrude into said transport path and a retreat position to retreat from said transport path, and wherein said control device drives said conveying device in said nip position to convey said sheets by said largest transport amount to let the whole leading edges of said sheets strike on said strike member in said protruded position, and thereafter switches said conveyer roller pairs to said nip position, said conveying device to said release position, and said strike member to said retreat position, and thereafter drives said conveyer roller pair to start conveying said sheets in parallel lines.

7. A conveyer as claimed in claim 1, wherein said conveying device comprises at least a pair of conveyer rollers which are able to switch over between a nip position to nip said sheets and a release position to release said sheets.

8. A conveyer as claimed in claim 1, wherein said conveying device comprises a number of apposed conveyer roller pairs, said number being equal to the number of said parallel lines of said sheets, and wherein said control device controls transport speeds of said conveyer roller pairs individually for each line such that the transport speed of one sheet whose necessary transport amount is calculated to be the largest is the highest among other lines.

9. A conveyer as claimed in claim 1, wherein said conveying device comprises at least a movable nip member which is able to switch over between a nip position to nip said sheet and a release position to release said sheet, and movable along said transport path.

10. A conveyer as claimed in claim 9, wherein a number of said movable nip members are apposed, one for one line of said sheets, and wherein said control device controls speeds of movement of said movable nip members along said transport path individually for each line, such that one sheet whose necessary transport amount is calculated to be the largest is conveyed at the highest transport speed among other lines.

11. A conveyer as claimed in claim 1, further comprising at least a magazine for supplying said sheets to said transport path, and a memory storing identifying data of said magazine and characteristics of said sheets supplied from said magazine in association with skew degree measurement data that is obtained previously by measuring skew degree of said sheets, wherein said control device retrieves said skew degree measurement data from said memory on the basis of said identifying data of said magazine and said characteristics of said sheets, to calculate said necessary transport amount.

12. An image recording apparatus for recording images on recording materials, comprising:

a conveying device for conveying plural sheets of said recording material in parallel lines along a transport path;

a strike member placed at a downstream position of said conveying device;

detectors for detecting a leading edge of each of said recording materials on each line; and a control device that calculates, based on respective widths and skew amounts of said recording materials, necessary transport amounts on respective lines, which are necessary for letting the whole leading edges of said recording materials strike on said strike member, and drives said conveying device to convey said sheets by the largest one of said calculated transport amounts so that said recording materials strike at their leading edges on said strike member and are bent flexibly, thereby to correct their skew, wherein said detectors include a plurality of sensors, arranged for each line in a direction orthogonal to said transport path, to detect skew degree, of each sheet on each line, from a difference in detection time of the leading edge of said sheet between said sensors of the same line.

13. An image recording apparatus as claimed in claim 12, wherein said image recording apparatus records images simultaneously on said recording materials while conveying said recording materials in parallel lines after having their skew corrected.

14. An image recording apparatus as claimed in claim 12, further comprising at least a magazine for supplying said recording materials to said transport path, and a memory storing identifying data of said magazine and characteristics of said recording materials supplied from said magazine in association with skew degree measurement data that is obtained previously by measuring skew degree of said recording materials, wherein said control device retrieves said skew degree measurement data from said memory on the basis of said identifying data of said magazine and said characteristics of said recording materials, to calculate said necessary transport amount.

* * * * *